US011421680B1

(12) United States Patent
Smith et al.

(10) Patent No.: US 11,421,680 B1
(45) Date of Patent: Aug. 23, 2022

(54) PACKING BORE WEAR SLEEVE RETAINER SYSTEM

(71) Applicant: Vulcan Industrial Holdings, LLC, Houston, TX (US)

(72) Inventors: Jason David Smith, Porter, TX (US); Kyle Matthew Ellisor, Katy, TX (US)

(73) Assignee: Vulcan Industrial Holdings, LLC, Houston, TX (US)

( * ) Notice: Subject to any disclaimer, the term of this patent is extended or adjusted under 35 U.S.C. 154(b) by 219 days.

(21) Appl. No.: 16/916,593

(22) Filed: Jun. 30, 2020

(51) Int. Cl.

| | |
|---|---|
| ***F04B 53/16*** | (2006.01) |
| ***F04B 53/02*** | (2006.01) |
| ***F04B 53/22*** | (2006.01) |
| ***F04B 53/14*** | (2006.01) |
| ***F04B 15/02*** | (2006.01) |
| *E21B 43/26* | (2006.01) |
| *F04B 1/00* | (2020.01) |

(52) U.S. Cl.
CPC ..... *F04B 53/168* (2013.01); *F04B 15/02* (2013.01); *F04B 53/02* (2013.01); *F04B 53/14* (2013.01); *F04B 53/22* (2013.01); *E21B 43/2607* (2020.05); *F04B 1/00* (2013.01)

(58) Field of Classification Search
CPC ..... F04B 53/168; F16J 10/04
USPC ..... 92/128, 171.1
See application file for complete search history.

(56) References Cited

U.S. PATENT DOCUMENTS

| | | | |
|---|---|---|---|
| 1,576,269 | A | 3/1926 | Durant |
| 1,595,459 | A | 8/1926 | Durant |
| 1,671,139 | A | 5/1928 | Wilson |
| 1,873,318 | A | 8/1932 | Eason |
| 1,914,737 | A | 6/1933 | Elms |
| 1,948,628 | A | 2/1934 | Penick |
| 1,963,684 | A | 6/1934 | Shimer |
| 1,963,685 | A | 6/1934 | Shimer |
| 2,011,547 | A | 8/1935 | Campbell |

(Continued)

FOREIGN PATENT DOCUMENTS

| | | |
|---|---|---|
| CN | 201149099 | 11/2008 |
| CN | 102410194 | 4/2012 |

(Continued)

OTHER PUBLICATIONS

Sur-Lock® Liner Retention System—Product Brochure (p. 16) (Year: 2017).*

(Continued)

*Primary Examiner* — Michael Leslie
(74) *Attorney, Agent, or Firm* — Hogan Lovells US LLP

(57) ABSTRACT

A fluid end includes a housing having a bore extending toward a cavity and a wear sleeve positioned within the bore. The fluid end also includes a plunger positioned within a plunger bore extending through the wear sleeve, the plunger reciprocating within the plunger bore. The fluid end further includes a wear sleeve retainer coupled to the housing and positioned to block axial movement of the wear sleeve, the wear sleeve retainer having external threads along a body that engage internal threads formed in the housing. The fluid end also includes an anti-rotation system, coupled to the housing, the anti-rotation system engaging the wear sleeve retainer to block rotation of the wear sleeve retainer in at least one direction. The fluid end further includes a packing nut coupled to the wear sleeve retainer.

23 Claims, 17 Drawing Sheets

(56) References Cited

U.S. PATENT DOCUMENTS 2,069,443 A 2/1937 Hill
2,103,504 A 12/1937 White
2,143,399 A 1/1939 Abercrombie
2,304,991 A 12/1942 Foster
2,506,128 A 5/1950 Ashton
2,547,831 A 4/1951 Mueller
2,713,522 A 7/1955 Lorenz
2,719,737 A 10/1955 Fletcher
2,745,631 A 5/1956 Shellman
2,756,960 A 7/1956 Church
2,898,082 A 8/1959 Almen
2,969,951 A 1/1961 Walton
2,982,515 A 5/1961 Clinton
2,983,281 A 5/1961 Bynum
3,049,082 A 8/1962 Barry
3,053,500 A 9/1962 Atkinson
3,063,467 A 11/1962 Roberts, Jr.
3,224,817 A 12/1965 Carter
3,276,390 A 10/1966 Bloudoff
3,288,475 A 11/1966 Benoit
3,459,363 A 8/1969 Miller
3,474,808 A 10/1969 Elliott
3,483,885 A 12/1969 Leathers
3,489,098 A 1/1970 Roth
3,489,170 A 1/1970 Leman
3,512,787 A 5/1970 Kennedy
3,809,508 A 5/1974 Uchiyama
3,907,307 A 9/1975 Maurer
3,931,755 A 1/1976 Hatridge
4,044,834 A 8/1977 Perkins
4,076,212 A 2/1978 Leman
4,184,814 A 1/1980 Parker
4,219,204 A 8/1980 Pippert
4,277,229 A 7/1981 Pacht
4,331,741 A 5/1982 Wilson
4,395,050 A 7/1983 Wirz
4,398,731 A 8/1983 Gorman
4,440,404 A 4/1984 Roach
4,508,133 A 4/1985 Hamid
4,518,359 A 5/1985 Yao-Psong
4,527,806 A 7/1985 Ungchusri
4,662,392 A 5/1987 Vadasz
4,754,950 A 7/1988 Tada
4,763,876 A 8/1988 Oda
4,770,206 A 9/1988 Sjoberg
4,807,890 A 2/1989 Gorman
4,811,758 A 3/1989 Piper
4,861,241 A 8/1989 Gamboa
4,919,719 A 4/1990 Abe
4,951,707 A 8/1990 Johnson
5,020,490 A 6/1991 Seko
5,052,435 A 10/1991 Crudup
5,061,159 A 10/1991 Pryor
5,062,450 A 11/1991 Bailey
5,080,713 A 1/1992 Ishibashi
5,088,521 A 2/1992 Johnson
5,127,807 A 7/1992 Eslinger
5,131,666 A 7/1992 Hutchens
5,149,107 A 9/1992 Maringer
5,209,495 A 5/1993 Palmour
5,249,600 A 10/1993 Blume
5,267,736 A 12/1993 Pietsch
5,273,570 A 12/1993 Sato
5,314,659 A 5/1994 Hidaka
5,478,048 A 12/1995 Salesky
5,533,245 A 7/1996 Stanton
5,540,570 A 7/1996 Schuller
5,572,920 A * 11/1996 Kennedy ..... F04B 53/168 92/128
5,626,345 A 5/1997 Wallace
5,636,688 A 6/1997 Bassinger
5,674,449 A 10/1997 Liang
5,834,664 A 11/1998 Aonuma
5,859,376 A 1/1999 Ishibashi
5,895,517 A 4/1999 Kawamura
5,949,003 A 9/1999 Aoki
6,139,599 A 10/2000 Takahashi
6,200,688 B1 3/2001 Liang
6,209,445 B1 * 4/2001 Roberts, Jr. ..... F04B 53/168 92/128
6,328,312 B1 12/2001 Schmitz
6,340,377 B1 1/2002 Kawata
6,382,940 B1 5/2002 Blume
6,436,338 B1 8/2002 Qiao
6,460,620 B1 10/2002 LaFleur
6,464,749 B1 10/2002 Kawase
6,482,275 B1 11/2002 Qiao
6,485,678 B1 11/2002 Liang
6,544,012 B1 4/2003 Blume
6,623,259 B1 9/2003 Blume
6,641,112 B2 11/2003 Antoff
6,695,007 B2 2/2004 Vicars
6,702,905 B1 3/2004 Qiao
6,880,802 B2 4/2005 Hara
6,910,871 B1 6/2005 Blume
6,916,444 B1 7/2005 Liang
6,951,165 B2 10/2005 Kuhn
6,951,579 B2 10/2005 Koyama
6,955,181 B1 10/2005 Blume
6,959,916 B2 11/2005 Chigasaki
7,000,632 B2 2/2006 McIntire
7,036,824 B2 5/2006 Kunz
7,144,440 B2 12/2006 Ando
7,168,440 B1 1/2007 Blume
7,186,097 B1 3/2007 Blume
7,222,837 B1 5/2007 Blume
7,290,560 B2 11/2007 Orr
7,296,591 B2 11/2007 Moe
7,335,002 B2 2/2008 Vicars
7,341,435 B2 3/2008 Vicars
7,506,574 B2 3/2009 Jensen
7,513,483 B1 4/2009 Blume
7,513,759 B1 4/2009 Blume
7,611,590 B2 11/2009 Liang
7,681,589 B2 3/2010 Schwegman
7,682,471 B2 3/2010 Levin
7,726,026 B1 6/2010 Blume
7,748,310 B2 * 7/2010 Kennedy ..... F04B 53/168 92/128
7,754,142 B2 7/2010 Liang
7,754,143 B2 7/2010 Qiao
7,757,396 B2 7/2010 Sawada
7,789,133 B2 9/2010 McGuire
7,793,913 B2 9/2010 Hara
7,828,053 B2 11/2010 McGuire
7,845,413 B2 12/2010 Shampine
7,861,738 B2 1/2011 Erbes
7,866,346 B1 1/2011 Walters
7,891,374 B2 2/2011 Vicars
7,954,510 B2 6/2011 Schwegman
7,992,635 B2 8/2011 Cherewyk
8,069,923 B2 12/2011 Blanco et al.
8,075,661 B2 12/2011 Chen et al.
8,083,506 B2 12/2011 Maki et al.
8,100,407 B2 1/2012 Stanton et al.
8,141,849 B1 3/2012 Blume
8,147,227 B1 4/2012 Blume
8,181,970 B2 5/2012 Smith
8,261,771 B2 9/2012 Witkowski et al.
8,287,256 B2 10/2012 Shafer et al.
8,291,927 B2 10/2012 Johnson et al.
8,317,498 B2 11/2012 Gambier
8,375,980 B2 2/2013 Higashiyama
8,376,723 B2 2/2013 Kugelev
8,402,880 B2 3/2013 Patel
8,430,075 B2 4/2013 Qiao
D687,125 S 7/2013 Hawes
8,479,700 B2 7/2013 Qiao
8,511,218 B2 * 8/2013 Cordes ..... F04B 47/00 92/128
8,522,667 B2 * 9/2013 Clemens ..... F04B 53/166 92/128
8,528,585 B2 9/2013 McGuire
8,534,691 B2 9/2013 Schaffer

(56) References Cited

U.S. PATENT DOCUMENTS 8,613,886 B2 12/2013 Qiao
8,662,864 B2 3/2014 Bayyouk
8,662,865 B2 3/2014 Bayyouk
8,668,470 B2 3/2014 Bayyouk
8,707,853 B1 4/2014 Dille
8,733,313 B2 5/2014 Sato
8,784,081 B1 7/2014 Blume
8,828,312 B2 9/2014 Yao
8,870,554 B2 10/2014 Kent
8,893,806 B2 11/2014 Williamson
8,894,392 B1 11/2014 Blume
8,915,722 B1 12/2014 Blume
8,940,110 B2 1/2015 Qiao
8,978,695 B2 3/2015 Witkowkski
8,998,593 B2 4/2015 Vicars
9,010,412 B2 4/2015 McGuire
9,103,448 B2 8/2015 Witkowski
9,150,945 B2 10/2015 Bei
9,157,136 B2 10/2015 Chou
9,157,468 B2 10/2015 Dille
9,206,910 B2 12/2015 Kahn
D748,228 S 1/2016 Bayyouk
9,260,933 B2 2/2016 Artherholt
9,261,195 B2 2/2016 Toynbee
9,273,543 B2 3/2016 Baca
9,284,631 B2 3/2016 Radon
9,284,953 B2 3/2016 Blume
9,285,040 B2 3/2016 Forrest
9,291,274 B1 3/2016 Blume
9,322,243 B2 4/2016 Baca
9,334,547 B2 5/2016 Qiao
9,340,856 B2 5/2016 Otobe
9,359,921 B2 6/2016 Hashimoto
9,365,913 B2 6/2016 Imaizumi
9,371,919 B2 6/2016 Forrest
9,376,930 B2 6/2016 Kim
9,377,019 B1 6/2016 Blume
9,382,940 B2 7/2016 Lee
9,416,887 B2 8/2016 Blume
9,435,454 B2 9/2016 Blume
9,441,776 B2 9/2016 Bryne
9,458,743 B2 10/2016 Qiao
9,464,730 B2 10/2016 Bihlet
9,500,195 B2 11/2016 Blume
9,506,382 B2 11/2016 Yeager
9,528,508 B2 12/2016 Thomeer
9,528,631 B2 12/2016 McCarty
9,534,473 B2 1/2017 Morris
9,534,691 B2 1/2017 Miller
9,556,761 B2 1/2017 Koyama
9,568,138 B2 2/2017 Arizpe
9,605,767 B2 3/2017 Chhabra
9,631,739 B2 4/2017 Belshan
D787,029 S 5/2017 Bayyouk
9,638,075 B2 5/2017 Qiao
9,638,337 B2 5/2017 Witkowski
9,650,882 B2 5/2017 Zhang
9,651,067 B2 5/2017 Beschorner
9,689,364 B2 6/2017 Mack
9,695,812 B2 7/2017 Dille
9,732,746 B2 8/2017 Chandrasekaran
9,732,880 B2 8/2017 Haines
9,745,968 B2 8/2017 Kotapish
9,784,262 B2 10/2017 Bayyouk
9,822,894 B2 11/2017 Bayyouk
9,845,801 B1 12/2017 Shek
9,857,807 B2 1/2018 Baca
9,915,250 B2 3/2018 Brasche
9,920,615 B2 3/2018 Zhang
9,927,036 B2 3/2018 Dille
9,945,362 B2 4/2018 Skurdalsvold
9,945,375 B2 4/2018 Zhang
9,989,044 B2 6/2018 Bayyouk
10,029,540 B2 7/2018 Seeger
10,041,490 B1 * 8/2018 Jahnke ..... F04B 53/22
10,082,137 B2 9/2018 Graham
10,094,478 B2 10/2018 Iijima
10,113,679 B2 10/2018 Shuck
10,184,470 B2 * 1/2019 Barnett, Jr. ..... F04B 53/007
10,190,197 B2 1/2019 Baker
10,197,172 B2 2/2019 Fuller
10,215,172 B2 2/2019 Wood
10,221,848 B2 3/2019 Bayyouk
10,240,594 B2 3/2019 Barnhouse, Jr.
10,240,597 B2 3/2019 Bayyouk
10,247,182 B2 4/2019 Zhang
10,247,184 B2 4/2019 Chunn
10,273,954 B2 4/2019 Brown
10,288,178 B2 5/2019 Nowell
10,316,832 B2 6/2019 Byrne
10,330,097 B2 6/2019 Skurdalsvold
10,344,757 B1 7/2019 Stark
10,364,487 B2 7/2019 Park
D856,498 S 8/2019 Bayyouk
10,378,535 B2 8/2019 Mahmood
10,378,538 B2 8/2019 Blume
10,393,113 B2 8/2019 Wagner
10,400,764 B2 9/2019 Wagner
10,415,348 B2 9/2019 Zhang
10,428,406 B2 10/2019 Yao
10,428,949 B2 10/2019 Miller
10,436,193 B1 * 10/2019 Jahnke ..... F04B 53/162
10,443,456 B2 10/2019 Hoeg
10,465,680 B1 11/2019 Guerra
10,472,702 B2 11/2019 Yeh
10,487,528 B2 11/2019 Pozybill
10,519,070 B2 12/2019 Sanders
10,519,950 B2 12/2019 Foster
10,526,862 B2 1/2020 Witkowski
10,527,036 B2 1/2020 Blume
10,557,446 B2 2/2020 Stecklein
10,557,576 B2 2/2020 Witkowski
10,557,580 B2 2/2020 Mendyk
10,563,494 B2 2/2020 Graham
10,563,649 B2 2/2020 Zhang
10,570,491 B2 2/2020 Hong
10,576,538 B2 3/2020 Kato
10,577,580 B2 3/2020 Abbas
10,577,850 B2 3/2020 Ozkan
10,591,070 B2 3/2020 Nowell
10,605,374 B2 3/2020 Takaki
10,626,856 B2 4/2020 Coldren
10,633,925 B2 4/2020 Panda
10,634,260 B2 4/2020 Said
10,640,854 B2 5/2020 Hu
10,655,623 B2 5/2020 Blume
10,663,071 B2 5/2020 Bayyouk
10,670,013 B2 6/2020 Foster
10,670,153 B2 6/2020 Filipow
10,670,176 B2 6/2020 Byrne
10,677,109 B2 6/2020 Qiao
10,677,240 B2 6/2020 Graham
10,677,365 B2 6/2020 Said
10,711,754 B2 7/2020 Nelson
10,711,778 B2 7/2020 Buckley
10,718,441 B2 7/2020 Myers
10,731,523 B2 8/2020 Qu
10,731,643 B2 8/2020 DeLeon
10,738,928 B2 8/2020 Arizpe
10,753,490 B2 8/2020 Fuller
10,753,495 B2 8/2020 Bayyouk
10,767,520 B1 9/2020 Hattiangadi
10,774,828 B1 9/2020 Smith
10,781,803 B2 9/2020 Kumar
10,787,725 B2 9/2020 Fujieda
10,801,627 B2 10/2020 Warbey
10,808,488 B2 10/2020 Witkowski
10,815,988 B2 10/2020 Buckley
10,830,360 B2 11/2020 Frank
10,851,775 B2 12/2020 Stark
10,865,325 B2 12/2020 Nakao
10,907,738 B2 2/2021 Nowell
10,914,171 B2 2/2021 Foster
10,934,899 B2 3/2021 Hattiangadi

(56) References Cited

U.S. PATENT DOCUMENTS 10,941,866 B2 3/2021 Nowell
10,954,938 B2 3/2021 Stark
10,961,607 B2 3/2021 Oshima
10,962,001 B2 3/2021 Nowell
D916,240 S 4/2021 Nowell
10,968,717 B2 4/2021 Tran
10,988,834 B2 4/2021 Lee
10,989,321 B2 4/2021 Hattiangadi
10,995,738 B2 5/2021 Blume
11,028,662 B2 6/2021 Rhodes
11,041,570 B1 6/2021 Buckley
11,078,903 B2 8/2021 Nowell
11,104,981 B2 8/2021 Chen
11,105,185 B2 8/2021 Spencer
11,105,327 B2 8/2021 Hurst
11,105,328 B2 8/2021 Bryne
11,105,428 B2 8/2021 Warbey
11,111,915 B2 9/2021 Bayyouk
11,131,397 B2 9/2021 Yan
D933,104 S 10/2021 Ellisor
D933,105 S 10/2021 Ellisor
D933,106 S 10/2021 Mullins
D933,107 S 10/2021 Mullins
11,149,514 B2 10/2021 Witkowski
11,162,859 B2 11/2021 Lei
11,181,101 B2 11/2021 Byrne
11,181,108 B2 11/2021 Brooks
11,231,111 B2 1/2022 Hurst
11,242,849 B1 2/2022 Smith
2002/0084004 A1 7/2002 Takahashi
2002/0124961 A1 9/2002 Porter
2002/0159914 A1 10/2002 Yeh
2003/0205864 A1 11/2003 Dietle
2003/0233910 A1 12/2003 Jeong
2004/0170507 A1 9/2004 Vicars
2004/0194576 A1 10/2004 Ando
2004/0234404 A1 11/2004 Vicars
2004/0255410 A1 12/2004 Schonewille
2004/0258557 A1 12/2004 Shun
2005/0095156 A1 5/2005 Wolters
2005/0200081 A1 9/2005 Stanton
2005/0226754 A1 10/2005 Or
2006/0002806 A1 1/2006 Baxter
2006/0027779 A1 2/2006 McGuire
2006/0045782 A1 3/2006 Kretzinger
2007/0086910 A1 4/2007 Liang
2007/0154342 A1 7/2007 Tu
2007/0273105 A1 11/2007 Stanton
2007/0295411 A1 12/2007 Schwegman
2008/0031769 A1 2/2008 Yeh
2008/0092384 A1 4/2008 Schaake
2008/0279706 A1 11/2008 Gambier
2009/0041611 A1 2/2009 Sathian
2009/0278069 A1 11/2009 Blanco
2009/0261575 A1 12/2009 Bull
2010/0272597 A1 12/2010 Qiao
2011/0079302 A1 4/2011 Hawes
2011/0142701 A1 6/2011 Small
2011/0189040 A1 8/2011 Vicars
2011/0255993 A1 10/2011 Ochoa
2012/0141308 A1 6/2012 Saini
2012/0163969 A1 6/2012 Ongole
2012/0304821 A1 12/2012 Ando
2013/0020521 A1 1/2013 Byrne
2013/0202457 A1 8/2013 Bayyouk
2013/0202458 A1 8/2013 Byrne
2013/0319220 A1 12/2013 Luharuka
2014/0083541 A1 3/2014 Chandrasekaran
2014/0083547 A1 3/2014 Hwang
2014/0196883 A1 7/2014 Artherholt
2014/0260954 A1 9/2014 Young
2014/0286805 A1 9/2014 Dyer
2014/0322034 A1 10/2014 Bayyouk
2014/0348677 A1 11/2014 Moeller
2015/0132157 A1 5/2015 Whaley
2015/0144826 A1 5/2015 Bayyouk
2015/0147194 A1 5/2015 Foote
2015/0219096 A1 8/2015 Jain
2015/0300332 A1 10/2015 Kotapish
2015/0368775 A1 12/2015 Baker
2016/0201169 A1 7/2016 Vecchio
2016/0215588 A1 7/2016 Belshan
2016/0238156 A1 8/2016 Hubenschmidt
2016/0245280 A1 8/2016 Todorov
2016/0319626 A1 11/2016 Dille
2016/0319805 A1 11/2016 Dille
2017/0067459 A1 3/2017 Bayyouk
2017/0089473 A1 3/2017 Nowell
2017/0097107 A1 4/2017 Hotz
2017/0159655 A1 6/2017 Morreale
2017/0218951 A1 8/2017 Graham
2017/0218993 A1 8/2017 Freed
2017/0297149 A1 10/2017 Shinohara
2017/0298932 A1 10/2017 Wagner
2017/0314097 A1 11/2017 Hong
2017/0342776 A1 11/2017 Bullock
2017/0342976 A1 11/2017 Reddy
2018/0017173 A1 1/2018 Nowell
2018/0058431 A1 3/2018 Blume
2018/0202434 A1 7/2018 Barnhouse, Jr.
2018/0298894 A1 10/2018 Wagner
2018/0312946 A1 11/2018 Gigliotti, Jr.
2018/0320258 A1 11/2018 Stewart
2018/0340245 A1 11/2018 Kernion
2018/0354081 A1 12/2018 Kalyani
2019/0011051 A1 1/2019 Yeung
2019/0017503 A1 1/2019 Foster
2019/0024198 A1 1/2019 Hong
2019/0024225 A1 1/2019 Tang
2019/0032685 A1 1/2019 Foster
2019/0032720 A1 1/2019 Bayyouk
2019/0047049 A1 2/2019 Fujieda
2019/0049052 A1 2/2019 Shuck
2019/0063427 A1 2/2019 Nowell
2019/0071755 A1 3/2019 Lee
2019/0072088 A1 3/2019 DeLeon
2019/0072089 A1 3/2019 Buckley
2019/0085806 A1 3/2019 Meibgeier
2019/0085978 A1 3/2019 Chase
2019/0101109 A1 4/2019 Cortes
2019/0107226 A1 4/2019 Bayyouk
2019/0120389 A1 4/2019 Foster
2019/0136842 A1 5/2019 Nowell
2019/0145400 A1 5/2019 Graham
2019/0145568 A1 5/2019 Nick
2019/0154033 A1 5/2019 Brooks
2019/0170137 A1 6/2019 Chase
2019/0170138 A1 6/2019 Bayyouk
2019/0194786 A1 6/2019 Chuang
2019/0226058 A1 7/2019 Fujieda
2019/0063430 A1 8/2019 Byrne
2019/0242373 A1 8/2019 Wernig
2019/0264683 A1 8/2019 Smith
2019/0292633 A1 9/2019 Porret
2019/0301314 A1 10/2019 Kamo
2019/0301447 A1 10/2019 Skurdalsvold
2019/0316685 A1 10/2019 Wang
2019/0376508 A1 12/2019 Wagner
2020/0056272 A1 2/2020 Hong
2020/0063899 A1 2/2020 Witkowkski
2020/0080660 A1 3/2020 Dyer
2020/0080661 A1 3/2020 Mullins
2020/0157663 A1 5/2020 Yang
2020/0158123 A1 5/2020 Chen
2020/0173317 A1 6/2020 Keating
2020/0023245 A1 7/2020 Blume
2020/0208776 A1 7/2020 Bayyouk
2020/0217424 A1 7/2020 Rasmussen
2020/0240531 A1 7/2020 Nowell
2020/0256149 A1 8/2020 Witkowski
2020/0284253 A1 9/2020 Foster
2020/0284365 A1 9/2020 Bayyouk
2020/0290118 A1 9/2020 Chen
2020/0291731 A1 9/2020 Haiderer

(56) References Cited

U.S. PATENT DOCUMENTS

| | | | | |
|---|---|---|---|---|
| 2020/0300240 | A1* | 9/2020 | Nowell | F16B 35/005 |
| 2020/0308683 | A1 | 10/2020 | Xue | |
| 2020/0347843 | A1 | 11/2020 | Mullins | |
| 2020/0355182 | A1 | 11/2020 | DeLeon | |
| 2020/0392613 | A1 | 12/2020 | Won | |
| 2020/0393054 | A1 | 12/2020 | Fuller | |
| 2020/0399979 | A1 | 12/2020 | Webster | |
| 2020/0400003 | A1 | 12/2020 | Webster | |
| 2020/0400130 | A1 | 12/2020 | Poehls | |
| 2020/0400132 | A1 | 12/2020 | Kumar | |
| 2020/0400140 | A1 | 12/2020 | Bayyouk | |
| 2020/0400242 | A1 | 12/2020 | Spencer | |
| 2021/0010113 | A1 | 1/2021 | Qiao | |
| 2021/0010470 | A1 | 1/2021 | Blume | |
| 2021/0017830 | A1 | 1/2021 | Witkowski | |
| 2021/0017982 | A1 | 1/2021 | Bayyouk | |
| 2021/0017983 | A1 | 1/2021 | Myers | |
| 2021/0040836 | A1 | 2/2021 | Baskin | |
| 2021/0054486 | A1 | 2/2021 | Kim | |
| 2021/0102630 | A1 | 4/2021 | Nowell | |
| 2021/0108734 | A1* | 4/2021 | Nowell | F04B 53/168 |
| 2021/0130936 | A1 | 5/2021 | Wu | |
| 2021/0148471 | A1 | 5/2021 | Murugesan | |
| 2021/0180156 | A1 | 6/2021 | Kim | |
| 2021/0190053 | A1 | 6/2021 | Wagner | |
| 2021/0190223 | A1 | 6/2021 | Bayyouk | |
| 2021/0197524 | A1 | 7/2021 | Maroli | |
| 2021/0215071 | A1 | 7/2021 | Oikawa | |
| 2021/0215154 | A1 | 7/2021 | Nowell | |
| 2021/0230987 | A1 | 7/2021 | Tanner | |
| 2021/0239111 | A1 | 8/2021 | Zitting | |
| 2021/0246537 | A1 | 8/2021 | Maroli | |
| 2021/0260704 | A1 | 8/2021 | Hu | |
| 2021/0270261 | A1 | 9/2021 | Zhang | |
| 2021/0285551 | A1 | 9/2021 | Renollett | |
| 2021/0310484 | A1 | 10/2021 | Myers | |
| 2021/0381504 | A1 | 12/2021 | Wagner | |
| 2021/0381615 | A1 | 12/2021 | Riedel | |
| 2021/0388832 | A1 | 12/2021 | Byrne | |

FOREIGN PATENT DOCUMENTS

| | | |
|---|---|---|
| CN | 102748483 | 10/2012 |
| CN | 102410194 | 4/2021 |
| EP | 0 414 955 | 3/1991 |
| EP | 0414955 | 3/1991 |

OTHER PUBLICATIONS

Sur-Lock® Liner Retention System—Video ( https://www.premiumoilfield.com/performance-enhancement/sur-lock/sur-lock-liner-retention-system.html) ( https://www.youtube.com/watch?v=6NZGeD5NkF8 ) (Year: 2017).*

Flowserve, "Dynamic Balance Plug Valve and Double DB Plug Valve: Installation, Operation and Maintenance," 2011, https://www.flowserve.com/sites/default/files/2016-07/NVENIM2005-00_0.pdf, 36 pages.

Weir Oil & Gas, "SPM Well Service Pumps & Flow Control Products TWS600S Fluid End Operation Instruction and Service Manual," Feb. 27, 2017, https://www.global.weir/assets/files/oil%20and%20gas%20ebrochures/manuals/tws600s-fluid-end-2p121260.pdf, 41 pages.

White Star Pump Co., "Maintenance Manual: Triplex Pump WS-1300/1600," 2005, http://www.whitestarpump.com/ES/docs/user_t.pdf, 45 pages.

KerrPumps, "Super Stainless Steel Better Than the Best," http://kerrpumps.com/superstainless?gclid=EAIaIQobChMIg47o482q6wIVifTICh2XPA-qEAAYASAAEgKrxPD_BwE, 2013, last accessed: Aug. 21, 2020, 6 pages.

KerrPumps, "Frac One Pumps—Fluid End—Fracing," http://kerrpumps.com/fracone, 2013, last accessed: Aug. 21, 2020, 3 pages.

KerrPumps, "KerrPumps—Frac Pump & Mud Pump Fluid End—Fluid End Pump," http://kerrpumps.com/fluidends, 2013, last accessed: Aug. 21, 2020, 6 pages.

Vulcan Industrial, "Vulcan," http://www.vulcanindustrial.com/, 2019, last accessed: Aug. 21, 2020, 3 pages.

Vulcan Industrial, "Vulcan," http://www.vulcanindustrial.com/fluid-ends/, 2019, last accessed: Aug. 21, 2020, 3 pages.

Covert Manufacturing, Inc., "Fluid End Block: Covert Manufacturing", (site visited Jul. 30, 2021), covertmfg.com, URL: <http://www.covertmfg.com/our-capabilities/fluid-end-block/> (Year: 2021).

Kerr Pumps, "the most advanced fluid ends", (site visited Aug. 5, 2021), Kerrpumps.com, URL: <http://kerrpumps.com/fluidends> (Year: 2021).

Shandong Baorun, 2250 Triplex Plunger Pump Fluid End Exchangeable with Spm, (site visited Aug. 5, 2021), made-in-china.com, URL: <https://sdbaorun.en.made-in-china.com/product/wNixIDXYrshL/China-2250-Triplex-Plunger-Pump-Fluid-End-Exchangeable-with-Spm.html> (Year: 2021).

John Miller, "The Reciprocating Pump, Theory, Design and Use," 1995, 2nd Edition, Krieger Publishing Company, Malabar, Florida, 1 page.

"QIH-1000 HP Quintuplex," Dixie Iron Works, 2017, https://web.archive.org/web/20171031221150/http:/www.diwmsi.com/pumping/qi-1000/.

Technical Manual MSI Hybrid Well Service Pump Triplex and Quintuplex Models, Dixie Iron Works, Mar. 12, 2019, 88 pages. https://www.diwmsi.com/pumping/qi-1000/.

Carpenter, "CarTech Ferrium C61 Data Sheet," 2015, 2 pages.

The American Heritage Dictionary, Second College Edition, 1982, 6 pages.

Matthew Bultman, "Judge in West Texas Patent Hot Spot Issues Revised Guidelines," Sep. 23, 2020, Bloomberg Law News, 3 pages.

David L. Taylor, "Machine Trades Blueprint Reading: Second Edition," 2005, 3 pages.

Blume, U.S. Pat. No. 6,544,012, issued Apr. 8, 2003, Fig. 12A.

Caterpillar, "Cat Fluid Ends for Well Stimulation Pumps," 2015, 2 pages.

Claim Chart for U.S. Pat. No. 6,544,012, 23 pages.

Claim Chart for U.S. Pat. No. 7,186,097, 22 pages.

Claim Chart for U.S. Pat. No. 7,845,413, 8 pages.

Claim Chart for U.S. Pat. No. 9,534,472, 8 pages.

Claim Chart for U.S. Pat. Pub. No. 2013/0319220, 17 pages.

Claim Chart for U.S. Pat. Pub. No. 2014/0348677, 10 pages.

Claim Chart for U.S. Pat. Pub. No. 2015/0132157, 23 pages.

Claim Chart for "GD-3000," 9 pages.

Claim Chart for "NOV-267Q," 14 pages.

Collins English Dictionary, "annular," https://www.collinsdictionary.com/us/dictionary/english/annular, 2021, 4 pages.

Collins English Dictionary, "circumference," https://www.collinsdictionary.com/US/dictionary/english/circumference, 2021, 7 pages.

Collins English Dictionary, "plug," https://www.collinsdictionary.com/us/dictionary/english/plug, 2021, 17 pages.

Collins English Dictionary, "profile," https://www.collinsdictionary.com/us/dictionary/english/profile, 2021, 10 pages.

Collins English Dictionary, "sleeve," "therethrough," "through," "tube," and "tubular," 8 pages.

Collins English Dictionary, "space," https://www.collinsdictionary.com/us/dictionary/english/space, 2021, 13 pages.

Collins English Dictionary, "stairstep," https://www.collinsdictionary.com/us/dictionary/english/stairstep, 2021, 3 pages.

Congressional Record—Extensions of Remarks, Apr. 18, 2007, pp. E773-E775.

Congressional Record, Mar. 7, 2011, 31 pages.

"Declaration of Steven M. Tipton, Ph.D., P.E., Submitted with Patent Owner's Preliminary Response," Sep. 11, 2020, 155 pages.

"Declaration of William D. Marscher, P.E.—U.S. Pat. No. 10,914,171," Feb. 11, 2021, 308 pages.

"Declaration of William D. Marscher, P.E.—U.S. Pat. No. 10,591,070," May 25, 2020, 209 pages.

Email dated Sep. 22, 2020 in PGR2020-00065, 3 pages.

(56) References Cited

OTHER PUBLICATIONS

Email dated Sep. 25, 2020 in Kerr Machine v Vulcan Industrial Holdings, 1 page.
U.S. Pat. No. 10,288,178
U.S. Pat. No. 10,519,950.
U.S. Pat. No. 10,591,070.
U.S. Appl. No. 16/722,139.
U.S. Appl. No. 13/773,271.
U.S. Appl. No. 15/719,124.
U.S. Appl. No. 16/814,267.
U.S. Appl. No. 17/120,121.
U.S. Appl. No. 62/234,483.
U.S. Appl. No. 62/315,343.
U.S. Appl. No. 62/318,542.
U.S. Appl. No. 62/346,915.
U.S. Appl. No. 62/379,462.
"Flush Free Sealing Benefits," Oct. 3, 2011, http://empoweringpumps.com/flush-free-sealing-benefits/, accessed May 9, 2020, 5 pages.
Gardner Denver, Well Servicing Pump Model GD-3000—Operating and Service Manual, Apr. 2011, 44 pages.
Gardner Denver, Well Servicing Pump Model GD-1000Q—Fluid End Parts List, Sep. 2011, 24 pages.
Gardner Denver, Well Servicing Pump Model HD-2250—Operating and Service Manual, Jan. 2005, 44 pages.
Gardner Denver, GD 2500Q HDF Frac & Well Service Pump, 2 pages.
Cutting Tool Engineering, "Groove milling," Aug. 1, 2012, https://www.ctemag.cojm/news/articles/groove-milling, accessed May 13, 2020, 11 pages.
VargusUSA, "Groovex Innovative Grooving Solutions—Groove Milling," Dec. 12, 2011, http://www.youtube.com/watch?v=vrFxHJUXjvk, 68 pages.
Kerr Pumps, Kerr KA-3500B/KA-3500BCB Plunger Pump Parts and Service Manual, 41 pages.
Kerr Pumps, Kerr KD-1250B/KD-1250BCB Plunger Pump Service Manual, 38 pages.
Kerr Pumps, Kerr KJ-2250B and KJ-2250BCB Plunger Pump Service Manual, 38 pages.
Kerr Pumps, Kerr KM-3250B / KM-3250BCB Plunger Pump Service Manual, 35 pages.
Kerr Pumps, Kerr KP-3300B / KP-3300BCB Plunger Pump Service Manual, 41 pages.
Kerr Pumps, Kerr KT-3350B/BCB KT-3400BCB Plunger Pump Service Manual, 46 pages.
Kerr Pumps, Kerr triplex pump km3250bcb 10,000 psi @ 5.1 gmp, Feb. 2, 2021, http://imged.com/kerr-triplex-pump-km3250bcb-10-000-psi-5-1-gmp-8234739.html, 2 pages.
Lex Machina, 77 Federal district court cases for Alan D Albright of W.D. Tex., http://law.lexmachina.com/court/txwd/judge/5198506/cases?status=open&filed_on-from=2020-02-19&filed_on-to=2020-04-19&pending-, 7 pages.
Lex Machina, Motion Metrics Report for 834 orders issued by District Judge Alan D Albright (ADA) in 1,603 cases from the Search for federal district court cases before Judge Alan D Albright, https://law.lexmachina.com/motions/motion_metrics?cases_key=yyix9Y8-k2k, generated on Sep. 23, 2020, 1 page.
Lex Machina, 6:20-cv-00200-ADA, *Kerr Machine Co.* v. *Vulcan Industrial Holding, LLC Docket Entries*, https://law.lexmachina.com/cases/2004206451#docket-entries, 6 pages.
Jonathan Maes, "Machining Square Inside Corners: Conquer the Nightmare!," accessed Sep. 8, 2020, https://makeitfrommetal.com/machining-square-inside-corners-the-night . . . , 22 pages.
Ross Mackay, "Process Engineering: Properly seal that pump," May 17, 2005, https://www.chemicalprocessing.com/articles/2005/465, 11 pages.
MSI Fluid End Components, https://www.scribd.com/document/421304589/Fluid-End, 1 page.
MSI Dixie Iron Works, Ltd., MSI QI-1000 Technical Manual for 1000 HP Quintuplex MSI QI-1000 Pump, Feb. 21, 2004, 90 pages.
MSI, Product Listing and Pricing, accessed Mar. 8, 2016, 19 pages.
National Oilwell Varco, 267Q-6M Quinuplex Plunger Pump: Parts List, Jul. 21, 2008, 13 pages.
Oil and Gas Well Servicing, Audit Procedures for Oil and Gas Well Servicing, May 2010, Texas Comptroller of Public Accounts, Audit Division, 68 pages.
Tony Atkins and Marcel Escudier, Oxford Dictionary of Mechanical Engineering, Oxford University Press, 2013, 10 pages.
Parker Hannifin Corporation and Autoclave Engineers, Technical Information, 2016, 16 pages.
Girdhar, Moniz and Mackay, "Chapter 5.4 Centrifugal pump design," Plant and Process Engineering 360, 2010, pp. 519-536.
Parker Hannifin Corporation, PolyPak Seals for Hydraulic Applications Catalog EPS 5370_PolyPak, 2015, 38 pages.
Paresh Girdhar and Octo Moniz, "Practical Centrifugal Pumps—Design. Operation and Maintenance," Newnes, 2005, 33 pages.
Reinhard Preiss, "Stress concentration factors of flat end to cylindrical shell connection with a fillet or stress relief groove subjected to internal pressure," 1997, Int. J. Pres. Ves & Piping, vol. 73, pp. 183-190.
Caterpillar, WS255 Quintuplex Well Stimulation Pump, 2 pages.
Gardner Denver Pumps, Redline Series Brochure, 3 pages.
Eaton Aerospace Group, Resilient Metallic Seals, TF100-35D, Oct. 2013, 60 pages.
Scott McKeown, "District Court Trial Dates Tend to Slip After PTAB Discretionary Denials—Patents Post-Grant," Jul. 24, 2020, Ropes & Gray, accessed Sep. 23, 2020, 3 pages.
Ricky Smith and R. Keith Mobley, "Rules of Thumb for Maintenance and Reliability Engineers—Chapter 14: Packing and Seals," Elsevier, 2008, pp. 239-250.
Schlumberger, Jet Manual 02—Reciprocating Pumps, Aug. 7, 2015, 63 pages.
Schlumberger, Treating Equipment Manual: Fluid Ends, Section 10, Apr. 2000, 87 pages.
SPM Oil & Gas, SPM QEM 3000 Frac Pump, 2021,4 pages.
Supplemental Declaration of Steven M. Tipton, Ph.D., P.E.—Case PGR2020-00065, U.S. Pat. No. 10,591,070, Mar. 2, 2021, 35 pages.
Servagroup, TPD 600 Triplex Pump Brochure, Mar. 24, 2011, 2 pages.
Utex Industries, Inc., Well Service Products Catalog, Jun. 2017, 51 pages.
Utex Industries, Inc., Well Service Packing—Packing Assemblies Complete & Replacement, May 2013, 40 pages.
Vargus Ltd., Groove Milling High Precision Tools for Groove Milling, Dec. 2012, pp. 2-22.
Declaration of Duncan Hall from Internet Archive/Wayback Machine, Feb. 3, 2021, Kerr Plunger Pump Manuals, 20 pages.
Michael Agnes, Editor, Webster's New World College Dictionary, Fourth Edition, 1999, 5 pages.
Weir SPM Oil & Gas, Grooveless Fluid End, 2008, 1 page.
Weir SPM Oil & Gas, Weir SPM General Catalog, 2009, 40 pages.
Weir SPM Oil & Gas, Well Service Pump Reference Guide, 2008, 55 pages.
*Intellectual Ventures I LLC* v *VMWare, Inc.*, Case No. 1:19-CV-01075-ADA, Document 91 (W.D. Tex Jun. 3, 2020), Defendant VMWare, Inc.'s Stipulation of Invalidity Contentions for U.S. Pat. No. 7,949,752, Jun. 3, 2020, 5 pages.
*Vulcan Industrial Holding, LLC* et al. v. *Kerr Machine Co.* Case No. 4:21-cv-433, Document 1, Complaint for Declaratory Judgment of Patent Non-lnfringement, Feb. 9, 2021, 17 pages.
*Trilogy Enterprises, Inc.*, v. *Trilogy Education Services, LLC*, Case. No. 6:19-cv-199-ADA-JCM, Document 35, Fifth Amended Scheduling Order, Sep. 8, 2020, 4 pages.
*Dr. Corneliu Bolbocean* v *Baylor University*, Case No. 6:19-CV-00465-ADA-JCM, Document 34, Scheduling Order, Apr. 6, 2020,4 pages.
*Kerr Machine Co.*, v *Vulcan Energy Services, LLC, Vulcan Industrial Holdings, LLC, and Cizion, LLC d/b/a/ Vulcan Industrial Manufacturing*, Case No. 6:21-CV-00044-ADA, Document 4, Plaintiff's Amended Complaint for Patent Infringement and Jury Demand, Jan. 19, 2021, 30 pages.
*Kerr Machine Co.*, v *Vulcan Energy Services, LLC, Vulcan Industrial Holdings, LLC, and Cizion, LLC d/b/a/ Vulcan Industrial*

(56) References Cited

OTHER PUBLICATIONS

*Manufacturing*, Case No. 6:21-CV-00044, Document 1, Plaintiff's Original Complaint for Patent Infringement and Jury Demand, Jan. 19, 2021, 47 pages.
*Kerr Machine Co.*, v *Vulcan Energy Services, LLC, Vulcan Industrial Holdings, LLC, and Cizion, LLC d/b/a/ Vulcan Industrial Manufacturing*, Case No. 6:21-CV-00044-ADA, Document 10, Plaintiff's Second Amended Complaint for Patent Infringement and Jury Demand, Feb. 1, 2021, 88 pages.
*Kerr Machine Co.*, v *Vulcan Industrial Holdings, LLC, Vulcan Energy Services, LLC, Cizion, LLC*, Case No. W-20-CV-00200-ADA-24, Order Setting Trial Date, Jun. 14, 2020, 1 page.
*Kerr Machine Co.*, v *Vulcan Industrial Holdings, LLC, Vulcan Energy Services, LLC, Cizion, LLC*, Case No. W-20-CV-00200-ADA-29, Order Setting Trial Date, Aug. 2, 2020, 1 page.
*Kerr Machine Co.*, v. *Vulcan Industrial Holdings, LLC*, Case. No. 6:20-CV-00200-ADA, Affidavit of Service, Apr. 7, 2020, 1 page.
*Kerr Machine Co.*, v *Vulcan Industrial Holdings, LLC, Vulcan Energy Services, LLC, and Cizion, LLC d/b/a/ Vulcan Industrial Manufacturing*, Case No. 6:20-CV-00200-ADA, Plaintiff's First Amended Complaint for Patent Infringement and Jury Demand, Jun. 4, 2020, 11 pages.
*Kerr Machine Co.*, v *Vulcan Industrial Holdings, LLC, Vulcan Energy Services, LLC, and Cizion, LLC d/b/a/ Vulcan Industrial Manufacturing*, Case No. 6:20-CV-00200-ADA, Document 26, Defendant Cizion, LLC d/b/a Vulcan Industrial Manufacturing, LLC's Motion to Dismiss or Transfer, Jul. 22, 2020, 10 pages.
*Kerr Machine Co.*, v *Vulcan Industrial Holdings, LLC, Vulcan Energy Services, LLC, and Cizion, LLC d/b/a/ Vulcan Industrial Manufacturing*, Case No. 6:20-CV-00200-ADA, Defendants' Opposed Motion to Stay Litigation Pending the Outcome of the Pending Post-Grant Review Proceeding Before the Patent Trial and Appeal Board, Jul. 31, 2020, 14 pages.
*Kerr Machine Co.*, v *Vulcan Industrial Holdings, LLC*, Case No. 6:20-CV-00200-ADA, Plaintiff's Preliminary Infringement Contentions, May 22, 2020, 50 pages.
*Kerr Machine Co.*, v *Vulcan Industrial Holdings, LLC, Vulcan Energy Services, LLC, and Cizion, LLC d/b/a/ Vulcan Industrial Manufacturing*, Case No. 6:20-CV-00200-ADA, Defendants' Preliminary Invalidity Contentions, Aug. 13, 2020, 29 pages.
*Kerr Machine Co.*, v *Vulcan Industrial Holdings, LLC, Vulcan Energy Services, LLC, and Cizion, LLC d/b/a/ Vulcan Industrial Manufacturing*, Case No. 6:20-CV-00200-ADA, Document 34, Scheduling Order, Aug. 11, 2020, 3 pages.
*Kerr Machine Co.*, v *Vulcan Industrial Holdings, LLC, Vulcan Energy Services, LLC, and Cizion, LLC d/b/a/ Vulcan Industrial Manufacturing*, Case No. 6:20-CV-00200-ADA, Document 38, Plaintiff's Second Amended Complaint for Patent Infringement and Jury Demand, Sep. 25, 2020, 11 pages.
*Kerr Machine Co.*, v *Vulcan Industrial Holdings, LLC, Vulcan Energy Services, LLC, and Cizion, LLC d/b/a/ Vulcan Industrial Manufacturing*, Case No. 6:20-CV-00200-ADA, Document 5, Standing Order regarding Scheduled Hearings n Civil Cases in Light of Chief Judge Garcia's 24 Amended Order, Mar. 24, 2020, 4 pages.
*Kerr Machine Co.*, v *Vulcan Industrial Holdings, LLC, Vulcan Energy Services, LLC, and Cizion, LLC d/b/a/ Vulcan Industrial Manufacturing*, Civil Docket for Case No. 6:20-cv-00200-ADA, accessed Sep. 11, 2020, 7 pages.
*Kerr Machine Co.*, v *Vulcan Industrial Holdings, LLC, Vulcan Energy Services, LLC, and Cizion, LLC d/b/a/ Vulcan Industrial Manufacturing*, Case No. 6:20-CV-00200-ADA, Document 54, Claim Construction Order, Dec. 3, 2020, 3 pages.
*Kerr Machine Co.*, v *Vulcan Industrial Holdings, LLC, Vulcan Energy Services, LLC, and Cizion, LLC d/b/a/ Vulcan Industrial Manufacturing*, Case No. 6:20-CV-00200-ADA, Docket Entry, Aug. 2, 2020, 1 page.
*Kerr Machine Co.*, v *Vulcan Industrial Holdings, LLC*, Case No. 6:20-CV-00200, Document 1, Plaintiff's Original Complaint for Patent Infringement and Jury Demand, Mar. 19, 2020, 39 pages.
*Adriana del Rocio Barberena-Rovira, et al.*, v *Kuiper Dairy, LLC, et al.*, Case No. 6:20-CV-00250-ADA-JCM, Document 20, Scheduling Order, Jul. 22, 2020, 4 pages.
*Acquanlan Deonshay Harris* v. *Cenlar, FSB*, Case No. 6:20-CV-00271-ADA-JCM, Document 13, Scheduling Order, Aug. 20, 2020, 4 pages.
Senior Living Properties, LLC c. Ironshore Speciality, Insurance Company, Case No. 6:20-CV-00282-ADA-JCM, Document 12, Scheduling Order, Jul. 7, 2020, 4 pages.
*Dionne Bracken*, Individually and as Next Friend of A.M.B., v *Michael D. Ashcraft and Envirovac Waste Transport Systems, Inc.*, Case No. 6:20-CV-00308-ADA-JCM, Document 17, Scheduling Order, Jul. 28, 2020, 4 pages.
*Kendra Coufal* v. *Roger Lee Thomas and Apple Logistics, Inc.*, Case No. 6:20-CV-00356-ADA-JCM, Document 12, Scheduling Order, Jul. 28, 2020, 4 pages.
*Tipton International, Inc.*, v. *Vetbizcorp, LLC and Samuel Cody*, Case No. 6:20-CV-00554-ADA-JCM, Document 8, Scheduling Order, Aug. 20, 2020, 4 pages.
*Dynaenergetics GmbH & Co. KG and Dynaenergetics US, Inc.*, v. *Hunting Titan, Ltd.; Hunting Titan, Inc.; and Hunting Energy Services, Inc.*, Case No. H-17-3784, Order, Sep. 4, 2020, 2 pages.
Slip Opinion, In re Sand Revolution LLC, Case No. 2020-00145 (Fed. Cir. Sep. 28, 2020), 3 pages.
In re Vulcan Industrial Holdings, LLC, Case No. 2020-00151 (Fed. Cir. Sep. 29, 2020), Petition for Writ of Mandamus, 43 pages.
*Densys Ltd.*, v. *3Shape Trios A/S and 3Shape A/S*, Case No. WA:19-CV-00680-ADA, Document 27, Scheduling Order, Apr. 8, 2020, 4 pages.
*Kerr Machine Co.* vs. *Vulcan Industrial Holdings, LLC*, Case No. WA:20-CV-00200-ADA, Order Setting Markman Hearing, May 29, 2020, 1 page.
Sur-Lock Liner Retention System—Video (https://premiumoilfield.com/performance-enhancements/sur-lock/sur-lock-liner-retention-system.html) (https://www.youtube.com/watch?v=6NZGeD5NkF8) (Year: 2017).
U.S. Appl. No. 17/241,680 titled "Fluid End and Center Feed Suction Manifold" filed Apr. 27, 2021.

* cited by examiner

PACKING BORE WEAR SLEEVE RETAINER SYSTEM

TECHNICAL FIELD

Embodiments of the subject matter disclosed herein generally relate to pump systems, and in particular to retainer systems.

BACKGROUND

Pumping systems may be used in a variety of applications, especially industrial applications where pumping systems are used to elevate a working fluid pressure. One such application is hydraulic fracturing systems, which use high pressure pumps to increase a fluid pressure of a working fluid (e.g., fracturing fluid, slurry, etc.) for injection into an underground formation. The working fluid may include particulates, which are injected into fissures of the formation. When the fluid is removed from the formation, the particulates remain and "prop" open the fissures, facilitating flow of oil and gas. The abrasive fluid, along with the high operating pressures, may lead to erosion within the pumping system, which may affect different components in different ways. Traditional systems have either modified materials of construction, for example by using expensive metals or coatings, or by introducing sacrificial components that are replaced over time. One such component is a wear sleeve, which is a cylindrical sacrificial component that lines a fluid end packing bore to provide a sealing surface for various sealing elements, such as plunger packing. The wear sleeve is designed to be sacrificial and a sealing surface that degrades over time, and as a result, leaks may occur. When the sealing surface degrades, the wear sleeve is removed and replaced. Typically, these wear sleeves are bolted directly onto the pump body, which uses multiple threaded fittings and may also be difficult to access.

SUMMARY

Applicants recognized the problems noted above herein and conceived and developed embodiments of systems and methods, according to the present disclosure, for retainer systems.

In an embodiment, a wear sleeve retainer system includes a wear sleeve retainer and an anti-rotation system. The wear sleeve retainer includes a body portion extending for a length, the body portion having a bore extending along an axis. The wear sleeve retainer also includes a mating component extending from the body portion and into the bore, the mating component being annular and having a smaller diameter than a bore diameter. The wear sleeve retainer further includes threads arranged circumferentially about at least a portion of an outer diameter of the body portion. The wear sleeve retainer also includes a profile formed about at least a portion of a face of the body portion, the profile including a valley and a flat, the valley having a smaller valley diameter than a flat diameter. The anti-rotation system includes a locking mechanism and a locking fastener extending through the locking mechanism at an angle, the locking fastener adapted to engage the valley.

In an embodiment, a fluid end includes a housing having a bore extending toward a cavity and a wear sleeve positioned within the bore. The fluid end also includes a plunger positioned within a plunger bore extending through the wear sleeve, the plunger reciprocating within the plunger bore. The fluid end further includes a wear sleeve retainer coupled to the housing and positioned to block axial movement of the wear sleeve, the wear sleeve retainer having external threads along a body that engage internal threads formed in the housing. The fluid end also includes an anti-rotation system, coupled to the housing, the anti-rotation system engaging the wear sleeve retainer to block rotation of the wear sleeve retainer in at least one direction. The fluid end further includes a packing nut coupled to the wear sleeve retainer.

In an embodiment, a method for installing a retainer system includes positioning a wear sleeve within a bore formed in a fluid end housing. The method also includes securing a wear sleeve retainer to the fluid end housing, the wear sleeve retainer engaging at least a portion of the wear sleeve. The method further includes securing an anti-rotation system to the wear sleeve retainer. The method includes positioning packing within a diameter of the wear sleeve. The method also includes threading a packing nut to the wear sleeve retainer.

In an embodiment, a wear sleeve retainer system includes a body portion extending for a length, the body portion having a bore extending along an axis. The system also includes a mating component extending from the body portion and into the bore, the mating component being annular and having a smaller diameter than a bore diameter. The system further includes threads arranged circumferentially about at least a portion of an outer diameter of the body portion. The system includes a profile formed about at least a portion of a face of the body portion, the profile including a valley and a flat, the valley having a smaller valley diameter than a flat diameter. The system also includes a plurality of blinds formed along the face of the body portion, the blinds being positioned circumferentially about the face and radially outward from the bore.

BRIEF DESCRIPTION OF THE DRAWINGS

The present technology will be better understood on reading the following detailed description of non-limiting embodiments thereof, and on examining the accompanying drawings, in which.

DETAILED DESCRIPTION

Figure 1:
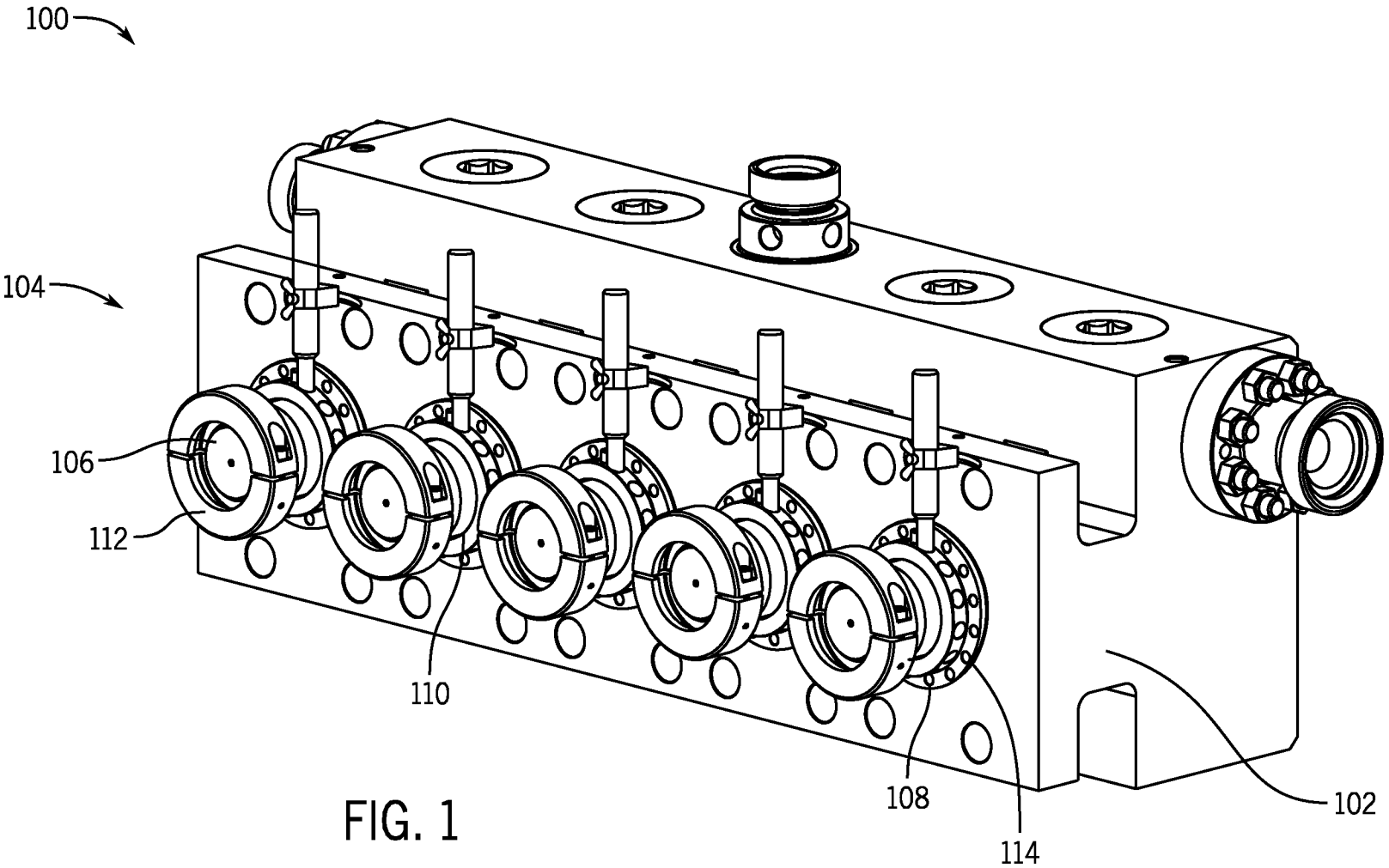
FIG. 1 is a perspective view of an embodiment of a fluid end, in accordance with embodiments of the present disclosure.

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions.

Embodiments of the present disclosure include a packing bore wear sleeve retainer system with an integrated anti-rotation device for use on positive displacement reciprocating pumps. Such pumps include hydraulic fracturing pumps, mud pumps, and similar plunger or piston pumps. Embodiments incorporate a wear sleeve retainer that has an outer diameter that is threaded and an internal diameter that is threaded at an end for receiving the mating component packing nut. On the opposite end, the wear sleeve retainer is configured geometrically to capture and secure the wear sleeve when it is fully threaded into the packing bore of the fluid end. The sleeve retainer is designed to secure the wear sleeve into the gland of the fluid end bore tightly and incorporates sealing elements to prevent high-pressure fluid leakage from the pumping chamber along with preventing leakage of high-pressure grease or oil, which is used to lubricate the plunger.

Embodiments of the present disclosure include features that allow the wear sleeve retainer to be removed and reassembled into the fluid end quickly by the operator and with ease by the use of a separate spanner wrench attachment tool that can be used in conjunction with industry standard ratchet style wrenches. Furthermore, embodiments include an integrated anti-rotation device. When the wear sleeve retainer is fully threaded into the packing bore of the fluid end, the device set screw bolt is tightened down and secures into one of multiple slots that are positioned at multiple points 360 degrees around the outer diameter, preventing the wear sleeve retainer from unthreading from the fluid end while in operation due to vibrations.

The wear sleeve is presented in various embodiments as a cylindrical sacrificial component that lines the fluid end packing bore to provide a sealing surface for the sealing elements (e.g., plunger packing), the wear sleeve is intended to be sacrificial, during pumping operations the packing will seal up on the plunger which is reciprocating in and out of the fluid end and the inner diameter of the wear sleeve. The sealing surface of the wear sleeve will begin to degrade with time due to high-pressure abrasive fluids eroding the material until it can no longer seal satisfactorily, and high-pressure fluid leakage will then occur causing washout metal erosion damage. At this point, maintenance occurs on the fluid end and the wear sleeve is removed from the fluid end and replaced with a new one. Embodiments of the present disclosure are directed a reliable, easy, and fast retention system to enable on-site maintenance by field service personnel. Prior art wear sleeve retainer systems incorporate a bolt on flange. The design is less reliable and slow to work on due to the many bolts that all required to be torqued down to specification. There is limited access space to maneuver tools to torque down the many bolts when the fluid end is attached to the pump, which is often the case when performing maintenance on the fluid end while the unit is on the job site. Another issue with prior art sleeve retainer designs is that they can at times begin to loosen or back out, causing the wear sleeve to be able to move back and forth in the gland, causing leakage or severe mechanical damage to the pump. Embodiments of the present disclosure overcome these problems by incorporating an integrated anti-rotation mechanical device that is fast and easy to use and prevents the wear sleeve retainer from backing out while pumping.

Embodiments of the present disclosure provide significant advantages over prior art systems and utilize a sleeve retainer system that threads into the fluid end via the use of a spanner wrench attachment and has an integrated anti-rotation lock mechanism to keep the sleeve retainer from backing out during pumping operations, thereby solving problems associated with back out during pumping, which may result in high pressure fluid leakage (washout erosion damage) or severe mechanical damage to pumping equipment. Embodiments of the present disclosure also eliminate the use of prior art bolts, which are torqued down to specification, this is difficult due to limited access behind the fluid end when being mounted to the power frame.

FIG. 1 is a perspective view of an embodiment of a fluid end 100. As noted above, fluid ends 100 may be utilized in industrial applications, such as oil and gas applications, to deliver high-pressure fluids to piping components leading to wellbores. For example, hydraulic fracturing operations use fluid ends 100 to increase a fluid pressure for fracturing fluid, which may be corrosive and/or abrasive, prior to injection into a wellbore. Fluid ends 100 are often coupled to engines, which provide motive power to drive reciprocation of various plungers. The engines may provide sufficient power to pressure fluid to pressure ranges from 5,000-25,000 pounds per square inch (psi).

The illustrated fluid end 100 includes a manifold body or housing 102 that is illustrated as a single, unitary piece, but it should be appreciated that the housing 102 may be formed of multiple sections. As will be appreciated, the housing 102 may include a conduit or bore that is represented as an inlet that received a low pressure fluid, a chamber that receives the low pressure fluid, and an outlet that intersects the chamber and discharges the high pressure fluid.

In this embodiment, the fluid end 100 includes five different plunger assemblies 104, each including a plunger 106, a wear sleeve retainer 108, a packing nut 110, and a flange 112. As shown, the wear sleeve retainer 108 is coupled directly to the housing 102 via fasteners 114, which are bolts in the illustrated embodiment. Because space is at a premium at a well site, it may be difficult to access the fasteners 114 when the wear sleeve (not pictured) is replaced. This may be difficult or time consuming for operators, which may lead to increased downtime at the site. Embodiments of the present disclosure include an improved system for retaining the wear sleeve as well as components for installation and removal.

Figure 2:
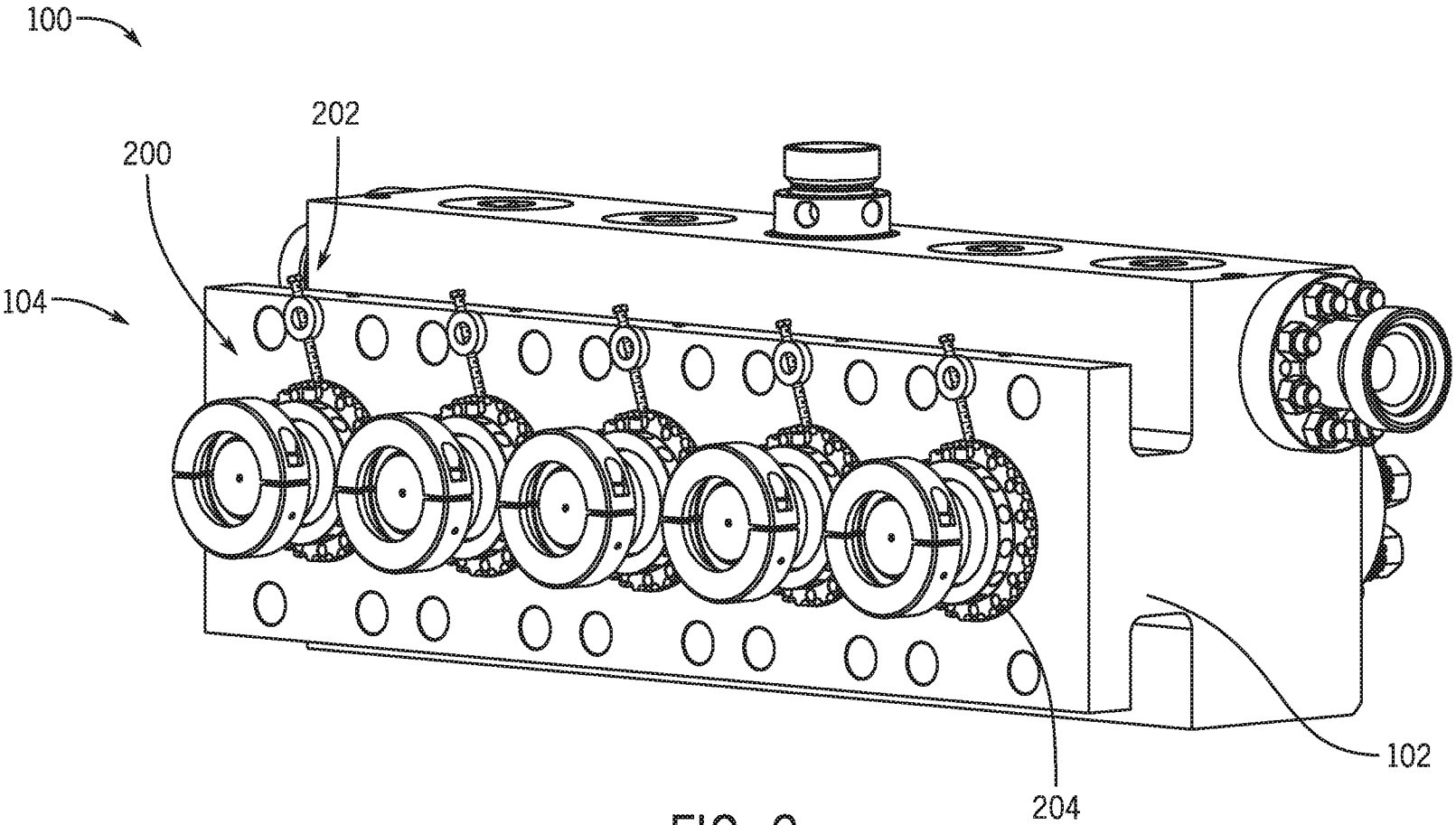
FIG. 2 is a perspective view of an embodiment of a fluid end, in accordance with embodiments of the present disclosure.

FIG. 2 is a perspective view of an embodiment of the fluid end 100 including the plunger assemblies 104 having a wear sleeve retainer system 200. As will be described in detail below, the system 200 does not include the fasteners 114, but rather, uses internal threads to couple components to the housing 102. Such an arrangement enables faster assembly and disassembly, thereby reducing time for maintenance. Furthermore, embodiments may include an anti-rotation system 202 that reduces the likelihood and/or backing out of a wear sleeve retainer 204 that forms part of the system 200. Accordingly, the wear sleeve (not pictured) is still replaceable and may be utilized as a sacrificial component, however, installation is simplified and faster.

Figure 3:
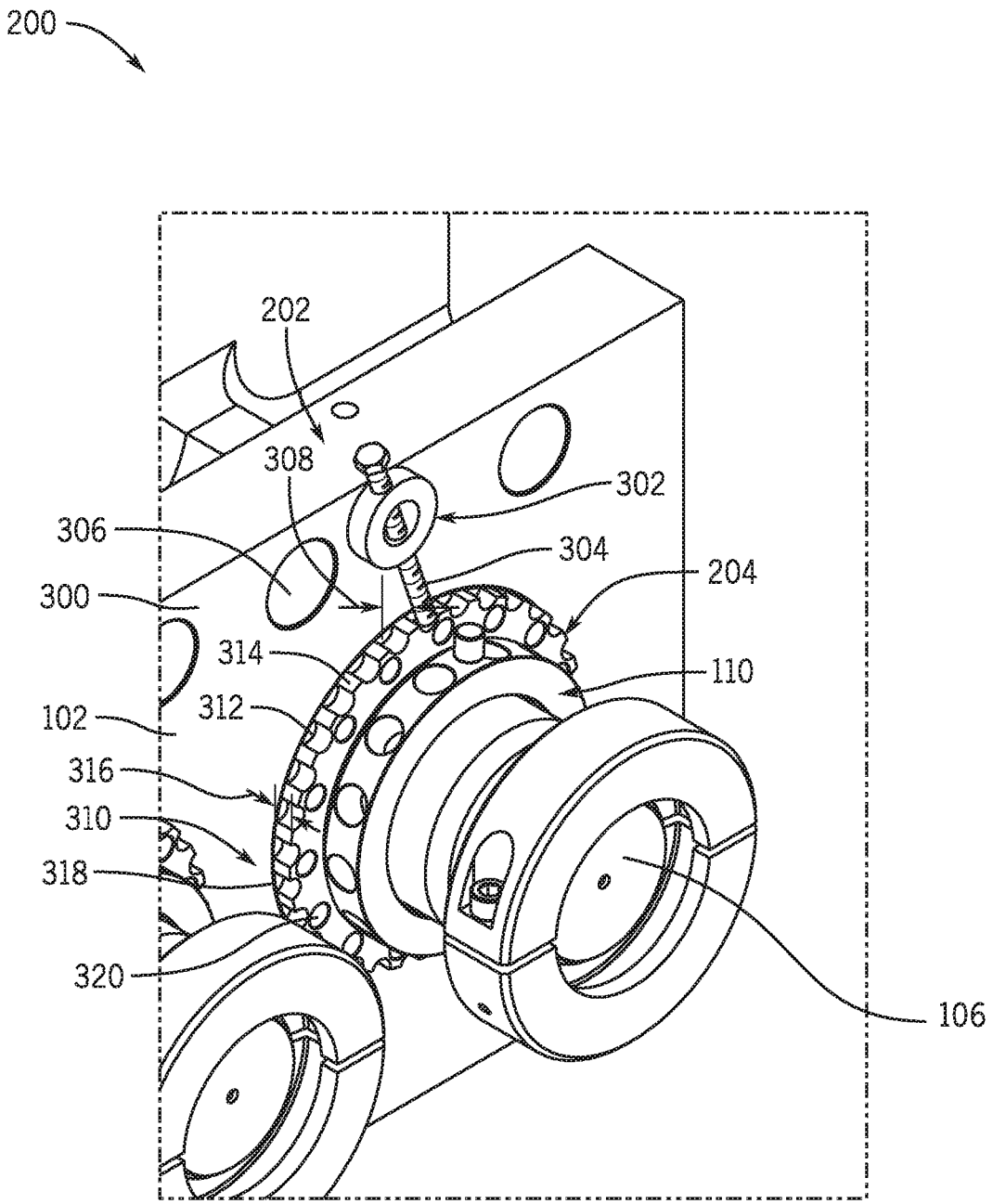
FIG. 3 is a perspective view of an embodiment of a retainer system, in accordance with embodiments of the present disclosure.

FIG. 3 is a perspective view of an embodiment of the system 200 coupled to the housing 102. In the illustrated embodiment, the wear sleeve retainer 204 is positioned against the housing 102, for example, against a housing external face 300 (e.g., face). It should be appreciated that in other embodiments there may be a recessed portion in the housing face 300, or a platform, to receive the wear sleeve retainer 204. In other words, the housing external face 300 may not be planar in all embodiments. As will be described below, the wear sleeve retainer 204 may engage internal threads formed along a bore extending through the housing 102 that receives the plunger 106. As a result, external fasteners for securing the wear sleeve retainer 204 to the housing 102 may be eliminated. That is, the fasteners 114 of FIG. 1 that provide a direct coupling that ends through the wear sleeve retainer 204 are reduced and/or eliminated by incorporating embodiments of the present disclosure.

The illustrated wear sleeve retainer 204 is secured against rotation by the anti-rotation system 202, which includes a locking mechanism 302 and a locking fastener 304. The locking mechanism 302 is secured to an aperture 306 formed in the housing 102. In various embodiments, the locking mechanism 302 is threaded into the aperture 306, press fit into the aperture 306, fastened to the aperture 306, or the like. For example, in an embodiment, a threaded fitting may be utilized to secure the locking mechanism 302 to the housing 102 via the aperture 306. In various embodiments, the aperture 306 is positioned in a particularly selected location to facilitate incorporation with the anti-rotation system and the wear sleeve retainer 204, as will be described below. However, in various other embodiments, the locking mechanism 302 may be adjustable to enable a modification of an anti-rotation angle of 308 of the locking fastener 304. As will be appreciated, even if threaded fasteners are utilized for the locking mechanism 302, a total of five threaded fasteners would be used for the illustrated embodiment (e.g., one for each of the five plunger assemblies 104), compared to potentially a dozen for each plunger assembly in prior configurations. The locking mechanism 302 receives the locking fastener 304, which is illustrated as a threaded bolt, which extends toward and engages the wear sleeve retainer 204. As shown, the locking fastener 304 is arranged at the anti-rotation angle 308 that is biased against a removal rotation for the wear sleeve retainer 204 (e.g., counter clockwise). By positioning the locking fastener 304 at the angle 308, forces may be distributed along two force component directions (e.g., vertically and horizontally), thereby enabling smaller locking fasteners 304. In this example, rotation in the counter clockwise direction is blocked due to engagement between the wear sleeve retainer 204 and the locking fastener 304. Accordingly, problems with traditional systems associated with backing out of wear sleeve retainers secured directly to the housing 102 by fasteners are overcome because each of the fasteners, such as the fasteners 114 of FIG. 1, are subjected to forces along a single plane. Moreover, as will be described, the locking fastener 304 may be marked or otherwise used as an indicator during installation and/or maintenance procedures.

The illustrated wear sleeve retainer 204 includes an outer circumference profile 310 having a plurality of spaced apart valleys 312 separated by flats 314. The valleys 312 are illustrated having a semi-circular shape with a radius, however, it should be appreciated that the valleys 312 may be any reasonable shape. For example, the valleys 312 may include sloped sides extending to trench or may include a single sloped side, among various other configurations. Moreover, the flats 314 may also be a different shape and are referred to as "flats" for illustrative purposes, but may include rounded edges or the like. In certain embodiments, the valleys 312 may also include a mating aperture for receiving the locking fastener 304. Each of the valleys 312 extend for a longitudinal valley depth 316 toward the housing external face 300. That is, the valleys 312 in the illustrated embodiment include a backstop 318, which may be a portion of a threaded body portion that is installed within a bore formed in the housing 102. The backstop 318 may provide a visual indication to the operator regarding installation of the wear sleeve retainer 204. For example, the backstop 318 may be substantially flush with the housing external face 300 to indicate full installation. However, it should be appreciated that the backstop 318 may also be recessed relative to the housing external face 300 to provide room for the locking fastener 304.

Further illustrated with respect to the wear sleeve retainer 204 are a plurality of blinds 320 positioned circumferentially about the wear sleeve retainer 204. The illustrated blinds 320 are radially inward, with respect to the valleys 312, and are positioned to align with the flats 314 in the illustrated embodiment. Such an arrangement is for illustrative purposes, and the blinds 320 may be particularly positioned based on a number of different factors. As will be described below, the blinds 320 may be utilized to receive a tool for installation of the wear sleeve retainer 204. For example, an extrusion or extension of a tool may be fitted to engage one or more blinds 320 to enable rotation of the wear sleeve retainer 204, thereby securing the wear sleeve retainer 204 to the housing 102.

FIG. 3 also includes the packing nut 110 positioned outward of the wear sleeve retainer 204 and also the plunger 106 extending through aligned bores extending through the wear sleeve retainer 204 and the packing nut 110. Accordingly, a familiar arrangement is maintained, which may simplify installation procedures for operators. Moreover, the illustrated configuration may enable other equipment to be utilized in the course of traditional operations, such as packing nut locks bars and the like.

Figure 4:
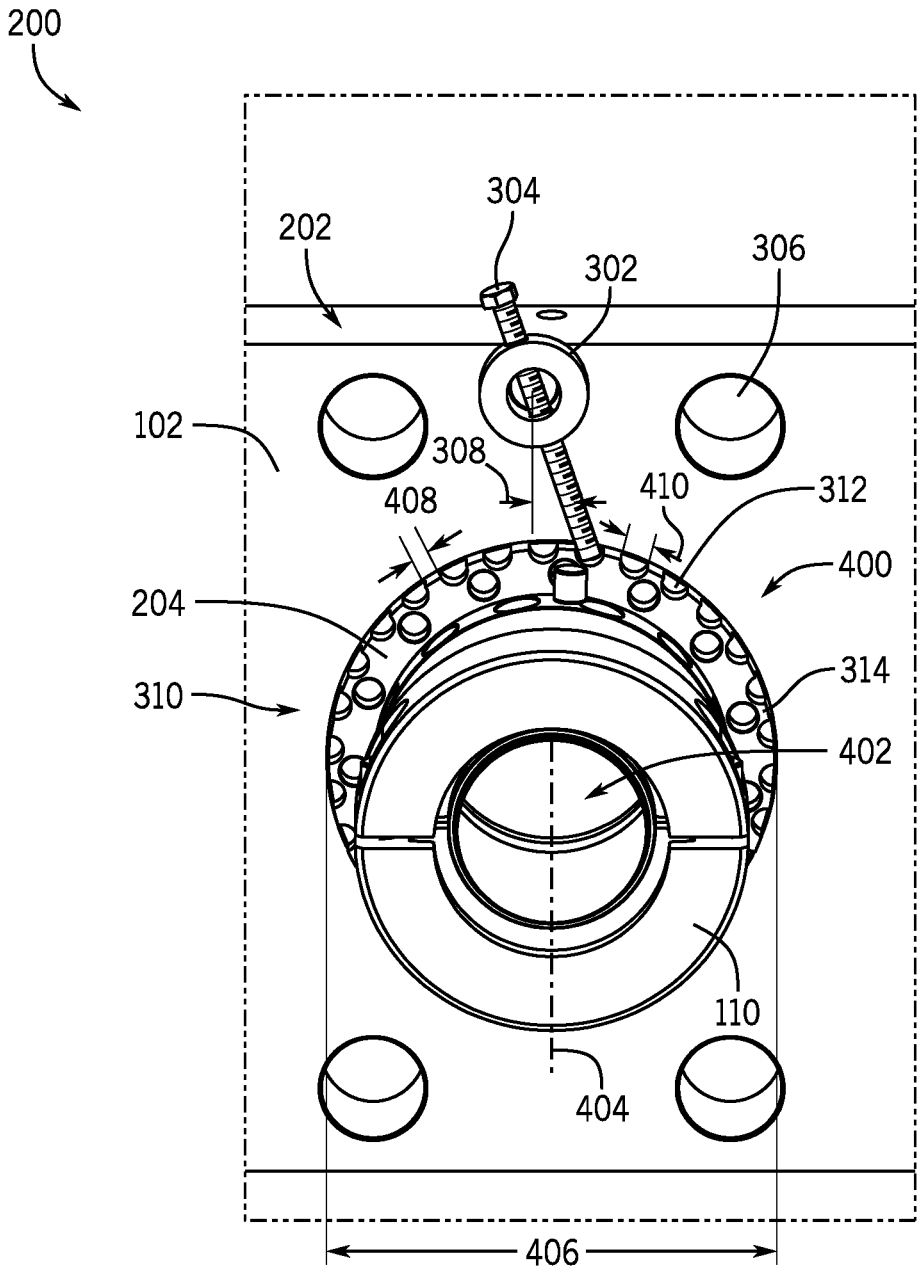
FIG. 4 is a perspective view of an embodiment of a retainer system, in accordance with embodiments of the present disclosure.

FIG. 4 is a front perspective view of an embodiment of the retainer system 200 in which the plunger 106 has been removed for clarity. As described above, in various embodiments the wear sleeve retainer 204 is installed within a bore 400 formed in the housing 102. The bore may also include a wear sleeve, packing, and the like, as will be described in detail below. In this embodiment, the wear sleeve retainer 204 is installed along the bore 400 via external threads formed on the wear sleeve retainer 204 and internal threads of the bore 400. Furthermore, in this embodiment, a plunger bore 402 is shown extending through both the wear sleeve retainer 204 and the packing nut 110. In operation, the plunger 106 is installed through the plunger bore 402 and reciprocates back and forth, along a plunger bore axis 404 in order to pressurize fluid within the housing 102.

As described above, the circumferential profile 310 is illustrated extending entirely around the wear sleeve retainer 204, thereby enabling installation of the wear sleeve retainer 204 in any orientation that facilitates alignment with the threads. In this embodiment, each of the valleys 312 is equally spaced about an outer diameter 406 of the wear sleeve retainer 204. However, it should be appreciated that different patterns or positions for the valleys 312 may be provided in various embodiments, Moreover, spacing between valleys 312 may be different. That is, a flat length 408 may vary at different regions. Furthermore, a valley length 410 may also vary between different valleys 312. Accordingly, various profile 310 configurations may be particularly selected for different operational goals, such as reducing weight, driving alignment of components, and the like.

As noted above, the anti-rotation system 202 includes the locking mechanism 302 installed within the aperture 306 with the locking fastener 304 extending through the locking mechanism 302 at the angle 308. This angle 308 may be particularly selected to transmit a rotational force in a counter clockwise direction, which would correspond to a direction that would unthread or back out the wear sleeve retainer 204. The illustrated angle 308 is approximately 30 degrees. However, it should be appreciated that the angle 308 may be any reasonable angle to prevent rotation of the wear sleeve retainer 204, such as approximately 15 degrees, approximately 35 degrees, approximately 45 degrees, approximately 50 degrees, or the like. Furthermore, it should be appreciated that the relative location of the anti-rotation system 200 is for illustrative purposes only and may be below the wear sleeve retainer 204, next to the wear sleeve retainer 204, or at any other reasonable location to engage at least a portion of the wear sleeve retainer 204 and to block rotation of the wear sleeve retainer 204.

Figure 5:
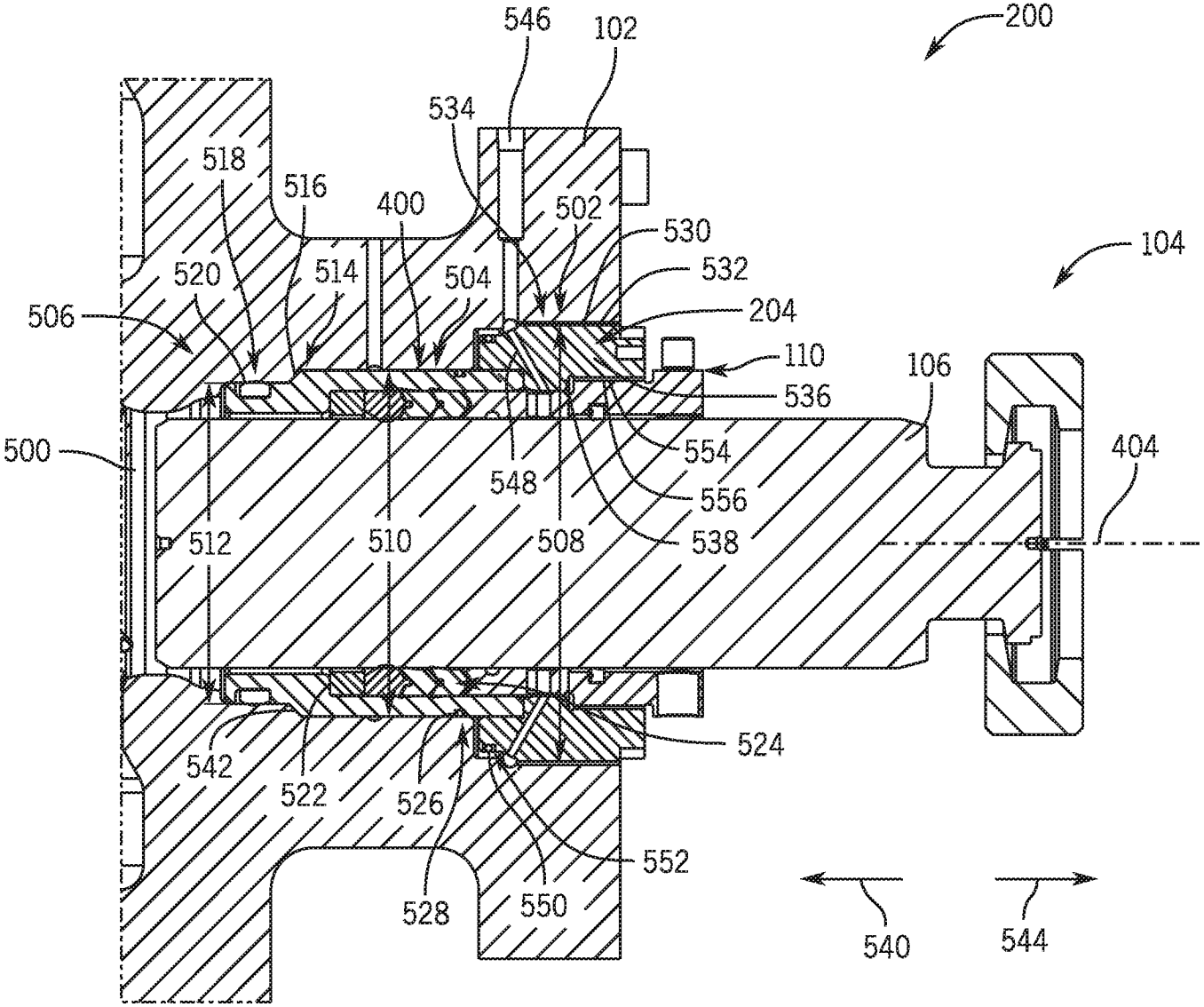
FIG. 5 is a cross-sectional view of an embodiment of a retainer system for a plunger assembly, in accordance with embodiments of the present disclosure.

FIG. 5 is a cross-sectional view of an embodiment of the retainer system 200 coupled to the housing 102. It should be appreciated that various features have been eliminated for simplicity with the following discussion. The illustrated embodiment includes the bore 400 extending through the housing 102 toward a cavity 500. The bore 400 includes a first bore section 502, a second bore section 504, and a third bore section 506, each having a different respective bore diameter. For example, a first bore section diameter 508 is larger than a second bore section diameter 510, which is larger than a third bore section diameter 512. It should be appreciated that this arrangement is for illustrative purposes and in various embodiments there may be more sections and/or different diameters.

The illustrated plunger assembly 104 includes a wear sleeve 514 arranged within the bore 400 and extending through each of the first, second, and third bore sections 502, 504, 506. The wear sleeve 514 is a stepped sleeve having a transition 516 where the diameter changes. The illustrated wear sleeve 514 is positioned to bear against a wear sleeve seal 518 positioned within a wear seal groove 520 formed in the wear sleeve 514. It should be appreciated that the seal 518 and groove 520 may also be formed in the housing 102 in other embodiments. The wear sleeve 514 also includes a shelf 522 that enables packing 524 to be installed along an inner portion of the wear sleeve 514, which may bear against the plunger 106 extending through the bore 400. The wear sleeve 514 also includes an external seal 526 in an external seal groove 528 for engaging the wear sleeve retainer 514. It should be appreciated that the external seal 526 and groove 528 may also be arranged within the wear sleeve retainer 204.

In operation, the wear sleeve 514 is installed within the bore 400 and the wear sleeve retainer 204 is utilized to secure the wear sleeve 514 at a desired position. In this embodiment, the housing 104 includes threads 530, which may engage mating threads 532 on the wear sleeve retainer 204. The illustrated threads 530 are formed along the bore 400 at the first bore section 502. In other words, the threads 530 in the illustrated embodiment may be described as being internal to the housing 102. These threads 530 engage the mating threads 532 formed along a body outer circumference 534 of a body 536 of the wear sleeve retainer 204. As will be appreciated, the body 536 may extend axially into the first bore section 502 a predetermined amount to facilitate engagement of the wear sleeve 514. In this example, a mating component 538 extends radially inward, toward the axis 404, to engage the wear sleeve 514. As a result, axial movement of the wear sleeve 514 is blocked along the axis 404. That is, axial movement in a first direction 540 toward the chamber 500 is blocked by a transition 542 along the bore 400 and axial movement in a second direction 544 toward the wear sleeve retainer 204 is blocked via the mating component 538 and an opposing force provided by the threads 530 and the mating threads 532. Accordingly, the wear sleeve 514 is secured in position within the bore 400.

In various embodiments, ports 546 are formed within the housing 102 and align with mating ports 548 formed in the wear sleeve retainer 204. As a result, grease or other lubricants may be added to various components, such as the plunger 106, without removing the packing assemblies 524. Moreover, various seals may also be utilized to block fluid leakage, such as the external seal 526 and/or a wear sleeve seal 550 positioned in a wear sleeve seal groove 552 formed in the body 536, which as noted above may also be formed in the housing 102.

Installation may also include the packing nut 110, which secures the packing 524 within the wear sleeve 514. The packing nut 110 may couple to the wear sleeve retainer 204, for example via threads 554 and mating threads 556 formed on the packing nut and the wear sleeve retainer 204, respectively. However, it should be appreciated that other coupling devices, such as clamps or fasteners, may also be utilized. Accordingly, embodiments of the present disclosure provide the retainer system 200 for maintaining a position of the wear sleeve 514 within the bore 400 without using external threads to directly couple the wear sleeve retainer 204 to the housing 102.

Figure 6:
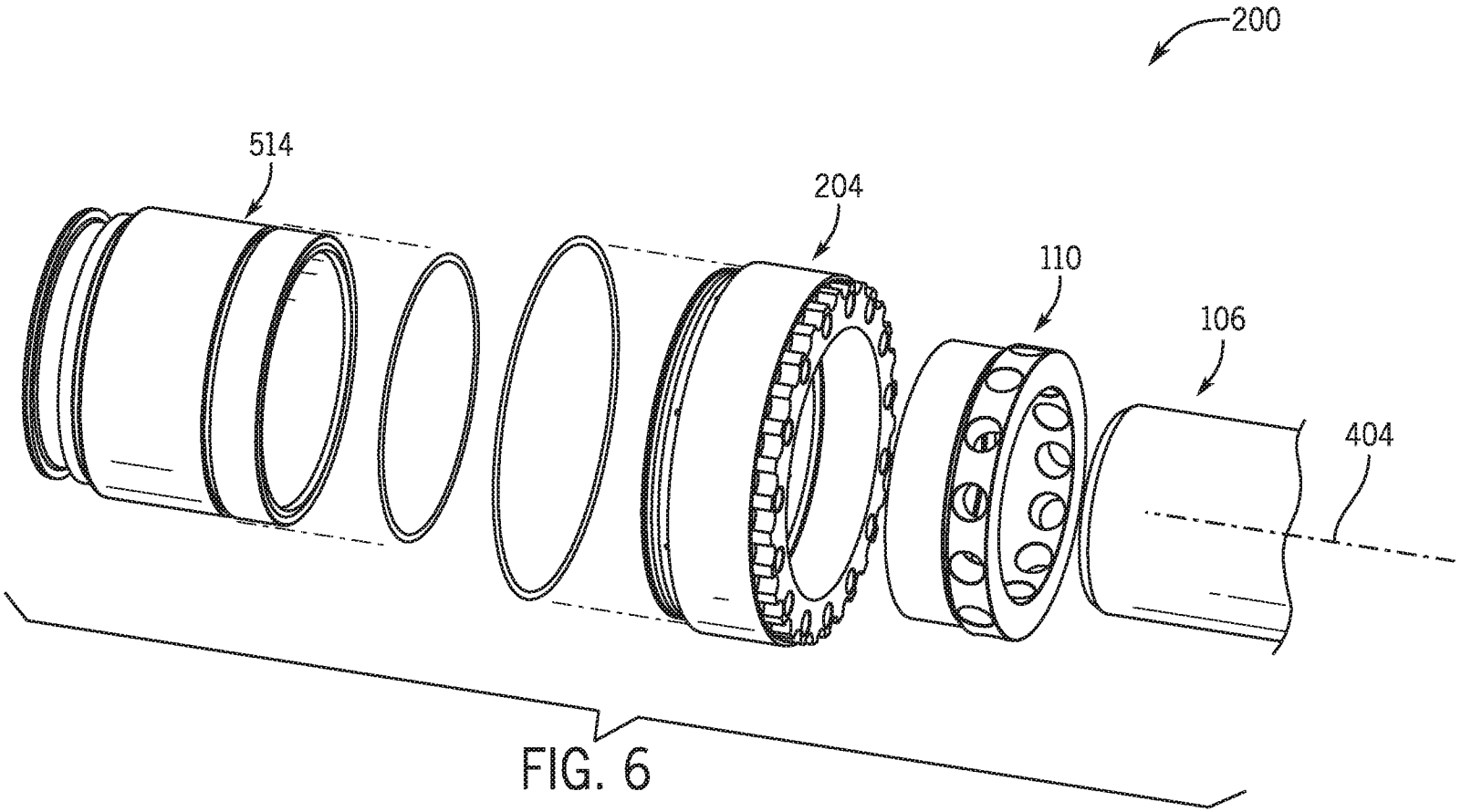
FIG. 6 is an exploded view of an embodiment of a retainer system, in accordance with embodiments of the present disclosure.

FIG. 6 is a partial exploded view of an embodiment of components of the retainer system 200 for securing the wear sleeve 514 within the bore 400. As noted above, features have been eliminated for clarity and conciseness. The illustrated embodiment shows each of the wear sleeve 514, wear sleeve retainer 204, packing nut 110, and plunger 106 being aligned along the axis 404, thereby enabling coaxial alignment within the bore 400.

Figure 7:
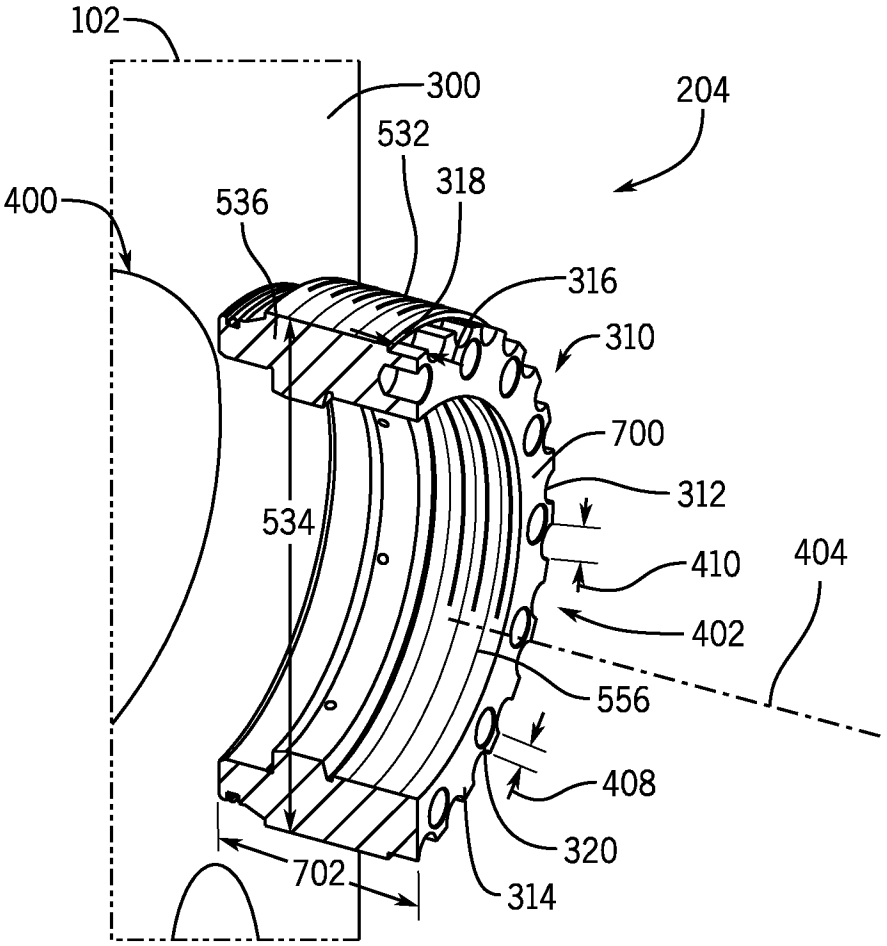
FIG. 7 is a perspective view of an embodiment of a wear sleeve retainer, in accordance with embodiments of the present disclosure.

FIG. 7 is cross-sectional perspective view of the wear sleeve retainer 204. As noted above, the illustrated wear sleeve retainer 204 is a generally cylindrical component that includes a body 536 extending axially from a face end 700 that is substantially aligned with the external housing face 300 when installed within the housing 102. The face end includes the blinds 320 arranged circumferentially about the face end 700, as well as the profile 310 along the circumference. As noted above, the profile includes the valleys 312 and flats 314, where the flats 314 extend for the length 408 and the valleys 312 extend for the length 410, each of which may be adjusted as particularly selected for various applications. In various embodiments, the valleys 312 extend for the valley depth 316 that does not extend through an entire length 702 of the wear sleeve retainer 204, but rather, to a backstop 318. The backstop 318 abuts the threads 532 formed along the outer body diameter 534, which may facilitate engagement with the threads 530 formed in the housing 102.

The plunger bore 402 of the wear sleeve retainer 204 also includes the threads 556 for coupling to the packing nut 110. Also provided within the plunger bore 402 is the mating component 538, which is illustrated as extending annularly around the plunger bore 402. The mating component 538 engages the wear sleeve 514, thereby blocking movement of the wear sleeve 514 out of the bore 400 toward the face end 700.

Figure 8:
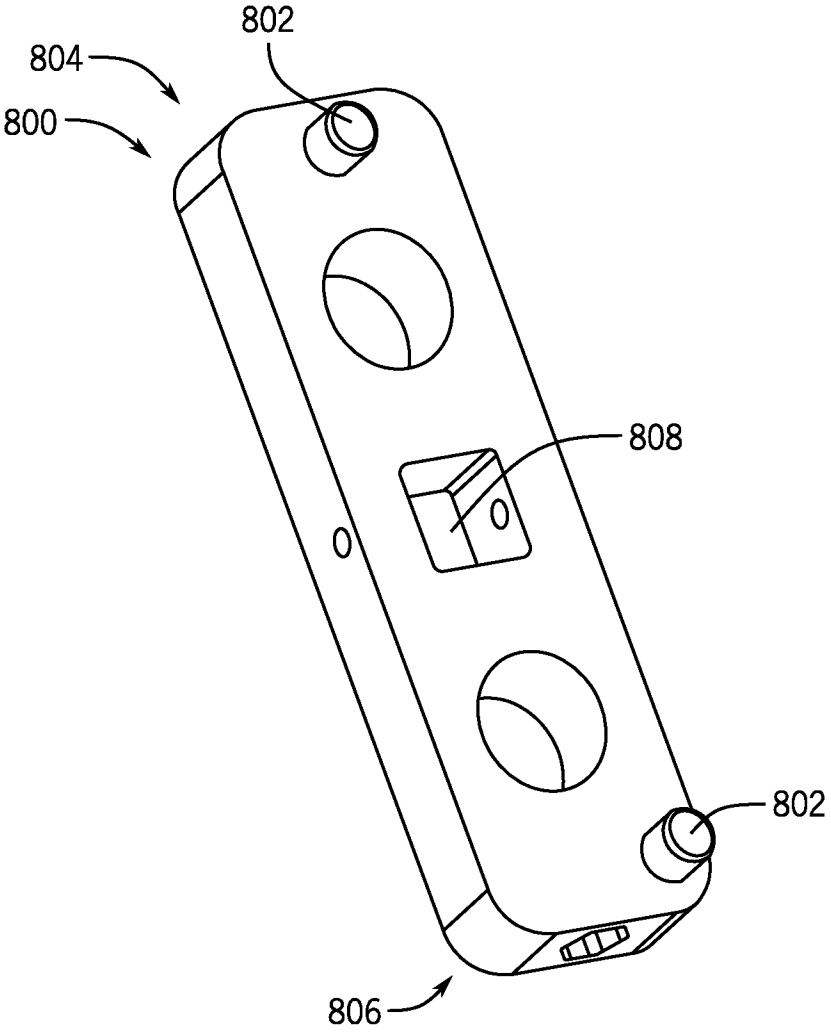
FIG. 8 is a perspective view of an embodiment of a lock body, in accordance with embodiments of the present disclosure.

FIG. 8 is a perspective view of an embodiment of a lock body 800 that may be utilized to install the wear sleeve retainer 204. The illustrated lock body 800 includes a pair of extensions 802 at opposite ends 804, 806 of the lock body 800. The illustrated extensions 802 are substantially circular and may be shaped to interact with the blinds 320 formed in the wear sleeve retainer 204. Accordingly, the lock body 800 may be aligned with the wear sleeve retainer 204 such that the extensions 802 interact with the blinds 320 to facilitate installation of the wear sleeve retainer 204, for example, by using a tool to rotate the wear sleeve retainer 204. The illustrated extensions 802 are positioned in a non-symmetrical arrangement in FIG. 8, however, it should be appreciated that the respective locations of the extensions 800 may be particularly selected based on the blind configuration of the wear sleeve retainer 204.

In various embodiments, the lock body 800 is configured to be adaptable to utilize existing tools, such as a ratchet wrench. Accordingly, the lock body 800 includes a coupling aperture 808 for receiving a mating tool part. In this manner, existing tools already present at the well site may be utilized with the lock body 800 to facilitate operations, thereby reducing clutter and leveraging existing components.

Figure 9:
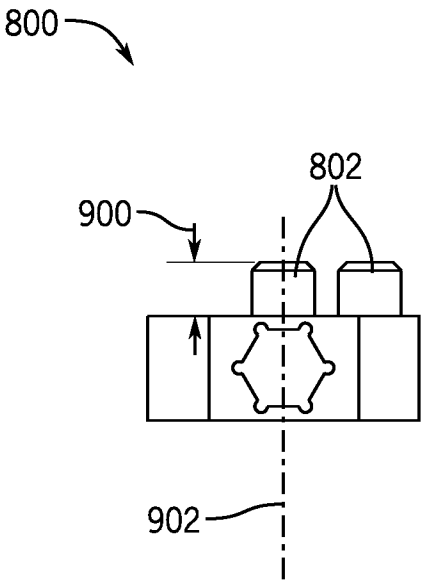
FIG. 9 is a front view of an embodiment of a lock body, in accordance with embodiments of the present disclosure.

FIG. 9 is a front elevational view of the lock body 800. In the illustrated embodiment, the extensions 802 have a length 900, which may be particularly selected based on the size of the associated blinds 320. In various embodiments, the extensions 802 may have different sizes, thereby providing a guide or indication regarding proper alignment or coupling to the wear sleeve retainer 204. In this example, the non-symmetrical arrangement of the extensions 802 is further illustrated, in that the extensions 802 are not symmetrical about centerline 902. This configuration may facilitate coupling at different circumferential positions of the wear sleeve retainer 204, which may enable reduced force applications for installation and removal.

Figure 10:
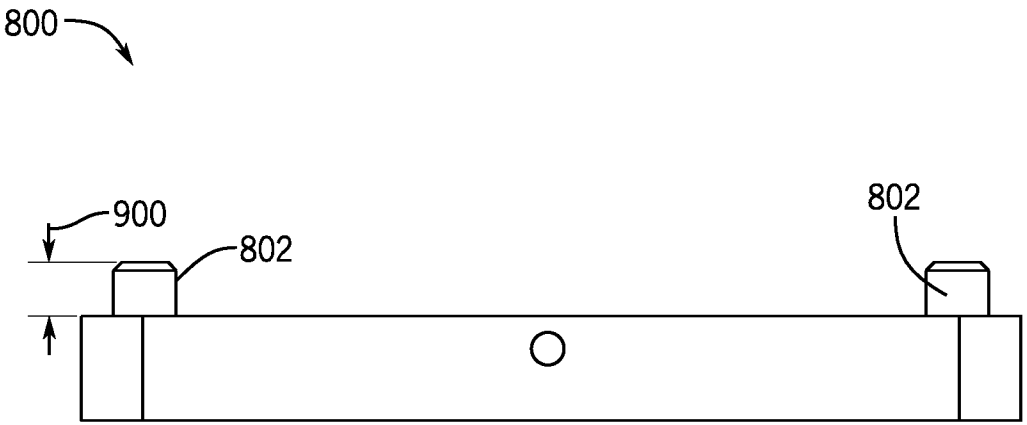
FIG. 10 is a side view of an embodiment of a lock body, in accordance with embodiments of the present disclosure.

FIG. 10 is a side elevational view of the lock body 800. As noted above, each of the extensions 802 extend for the same length 900, but, in various embodiments the lengths 900, along with the shapes of the extensions 802, may be different. It should be appreciated that various other dimensions of the lock body 800, such as the width, thickness, length, etc. may be particularly selected based on operating conditions.

Figure 11A:
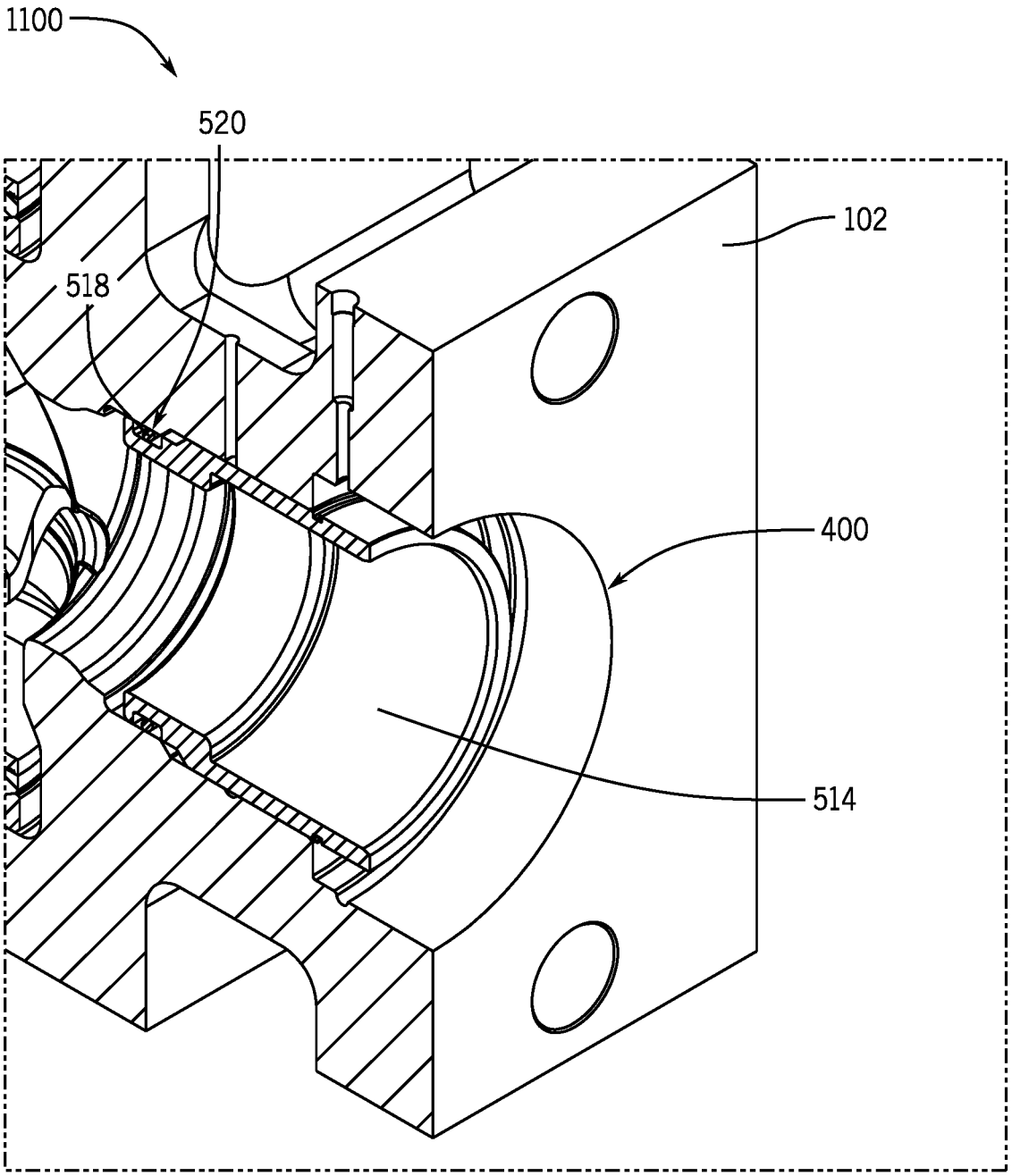
FIGS. 11A-11E are perspective views of embodiments of an installation procedure, in accordance with embodiments of the present disclosure.
Figure 11B:
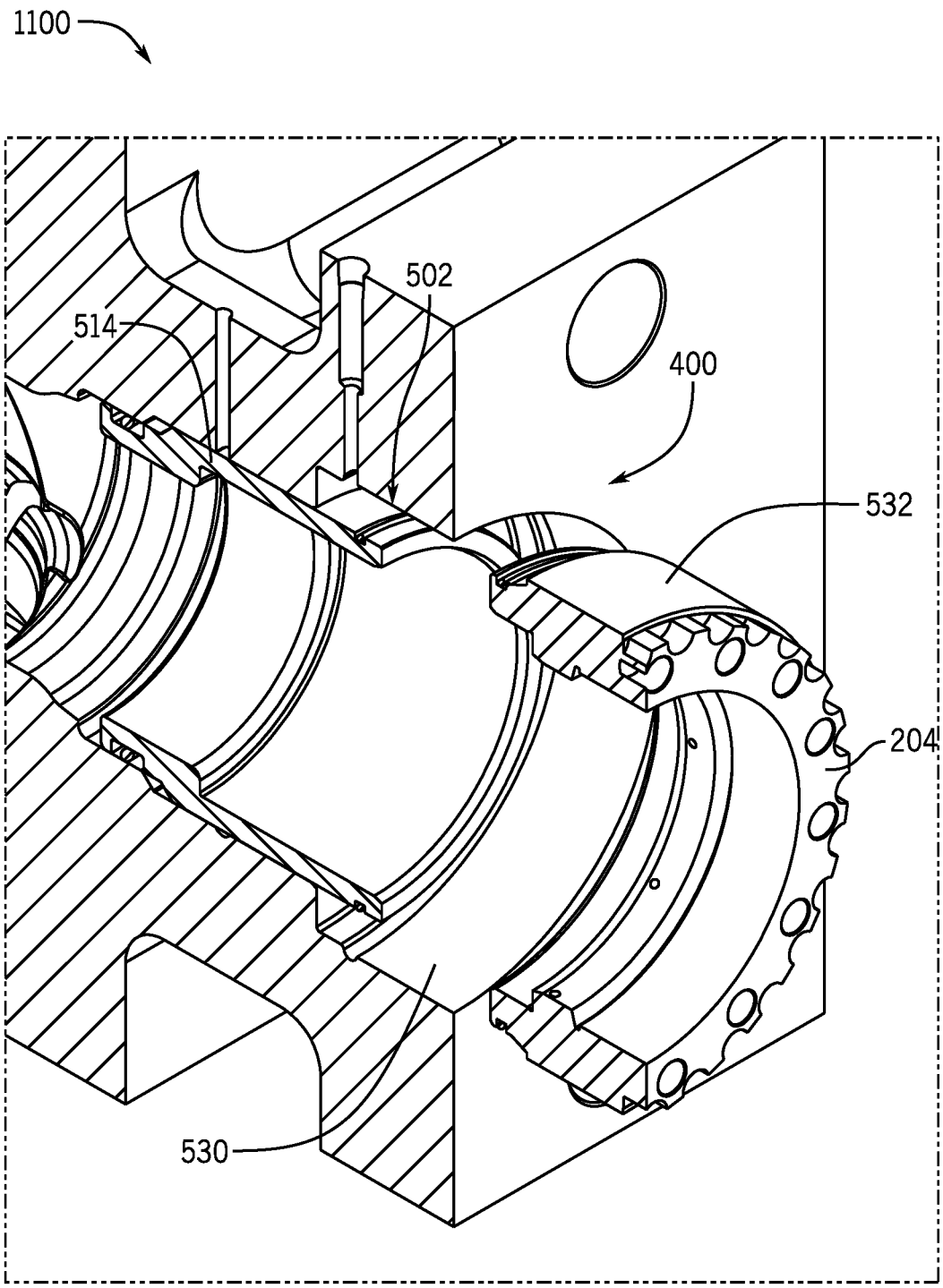

FIGS. 11A-11E illustrate perspective views of an installation procedure 1100 for securing the wear sleeve 514 within the bore 400 using the retainer system 200. As noted above, various components and have been removed for simplicity with the following explanation, for example steps involving applying coatings, grease, lubrication, installing seals, and the like. Additionally, features such as threads and the like have been removed for clarity, however, threaded components have been described elsewhere herein. Furthermore, the steps may be performed in a different order, unless otherwise indicated. FIG. 11A illustrates the wear sleeve 514 installed within the bore 400 such that the bore 400 engages the seal 518 positioned within the seal groove 520. In various embodiments, the wear sleeve 514 is inserted into the bore 400. FIG. 11B illustrates the procedure 1100 of wear sleeve retainer 204 aligned with the bore 400. As noted above, the wear sleeve retainer 204 may be installed within the bore 400 such that the mating threads 532 engage the threads 530 formed along the first bore section 502.

Figure 11C:
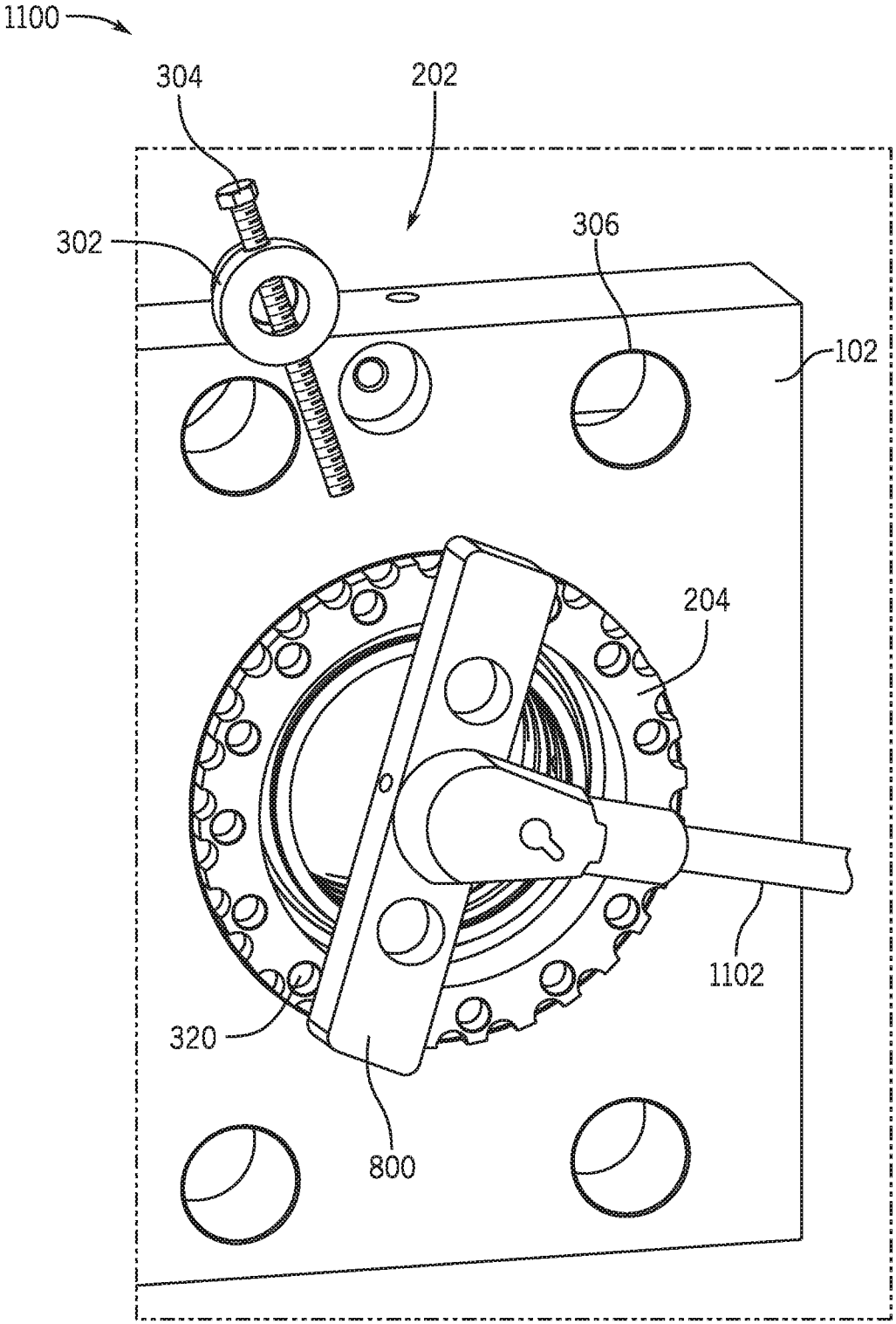

FIG. 11C illustrates the procedure 1100 of the installation of the wear sleeve retainer 204 using the lock body 800 and as associated tool 1102, which in this instance is a ratchet wrench. As shown, the anti-rotation system 202 is already installed within the aperture 306, for example, by bolting the locking mechanism 302 to the housing 102, among other options. The locking fastener 304 of the illustrated embodiment is positioned through the locking mechanism 302 and backed off such that the locking fastener 304 does not engage the wear sleeve retainer 204. Accordingly, the wear sleeve retainer 204 may be installed within the bore 400 by rotating the wear sleeve retainer 204 to a predetermined position indicative of engagement with the threads 530.

Figure 11D:
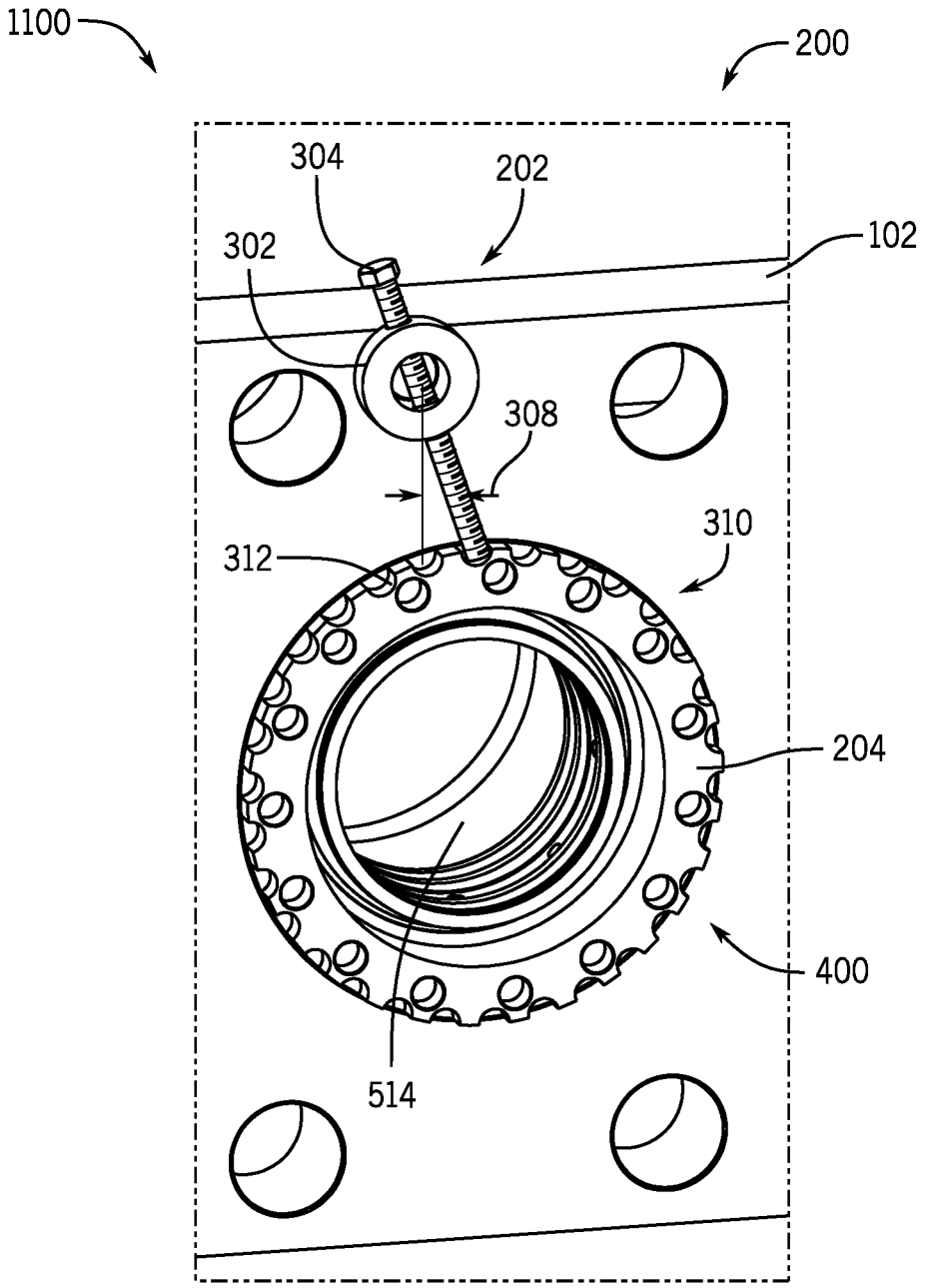

FIG. 11D illustrates the procedure 1100 of the engagement of the wear sleeve retainer 204 via the locking fastener 304. The locking fastener 304 extends through the locking mechanism 302 until it engages the valley 312. In various embodiments, the angle 308 is particularly selected to engage the wear sleeve retainer 204 at a predetermined location. This embodiment illustrates engagement between 12 o'clock and 1 o'clock positions, however, different configurations may also be utilized in various embodiments. Furthermore, while a single anti-rotation system 202 is shown for the illustrated plunger assembly 104, multiple anti-rotation systems 202 may be used, for example at different locations and/or the locking mechanism 302 may include multiple locking fasteners 304.

Figure 11E:
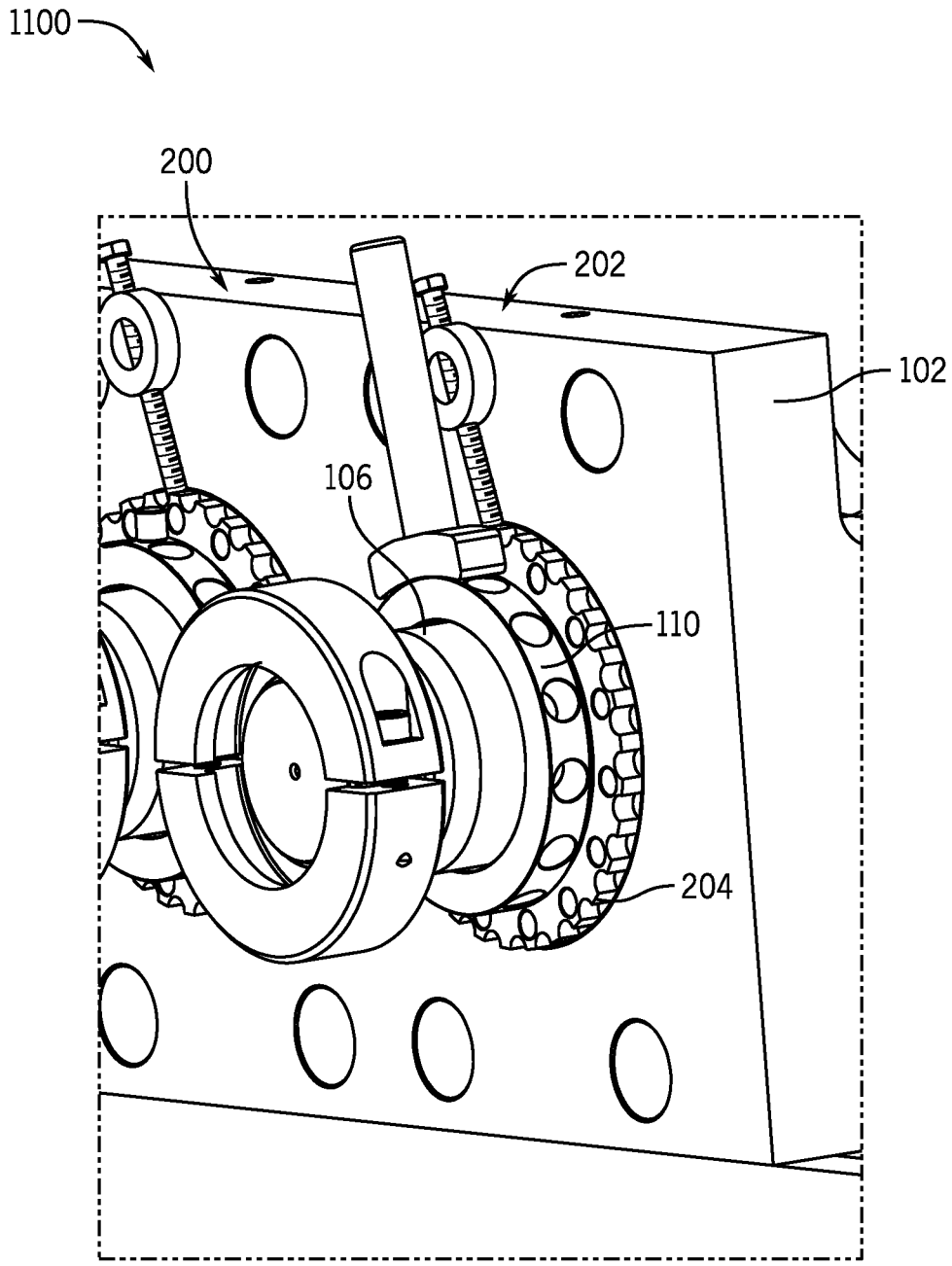

FIG. 11E illustrates the procedure 1100 of the packing nut 110 installed to engage the wear sleeve retainer 204, for example via the threads 554, 556 along with the plunger 106 installed within the plunger bore 402. In various embodiments, the packing 524 is installed prior to installation of the packing nut 110. It should be appreciated that components may be removed by reversing the steps described herein, for example, by removing the packing nut 110, removing the packing 524, disengaging the anti-rotation system 202, removing the wear sleeve retainer 204, and then removing the wear sleeve 514.

Figure 12A:
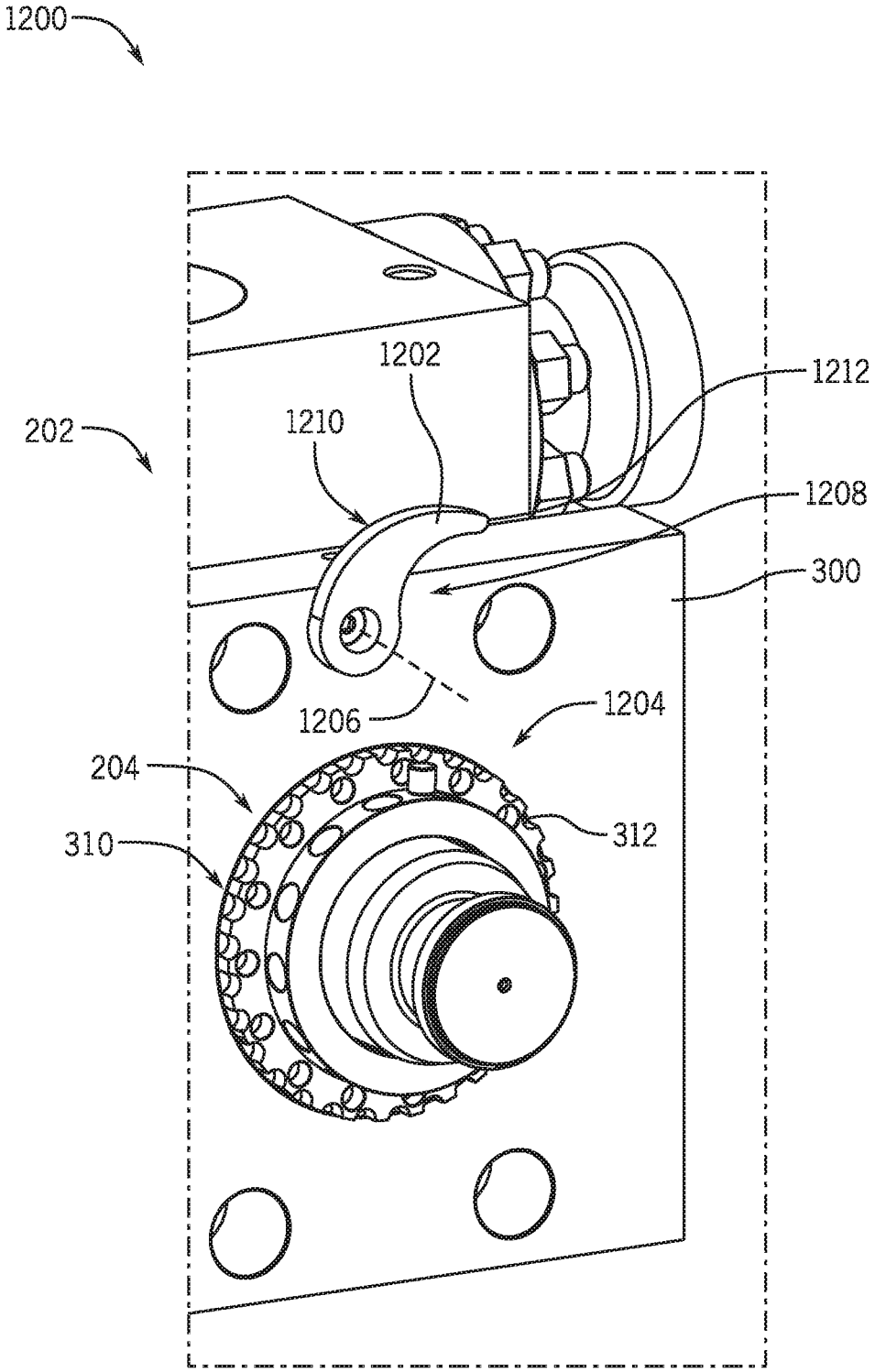
FIGS. 12A and 12B are perspective views of embodiments of a ratchet and pawl anti-rotation system, in accordance with embodiments of the present disclosure.

FIG. 12A is a perspective view of an embodiment of the anti-rotation system 202 using a ratchet and pawl system 1200. In this embodiment, the locking mechanism 302 and locking fastener 304 are replaced with a pawl 1202 while the circumferential profile 310 (e.g., the valleys 312 and flats) of the wear sleeve retainer 204 function as a ratchet 1204. It should be appreciated that, in various embodiments, the systems may be used interchangeably. By way of example, if there are 5 retainer systems 200 used on a fluid end 100, one or more may use the locking mechanism 302 and the locking fastener 304 and one or more may use the pawl 1202.

The illustrated pawl 1202 is coupled to the external face 300 of the fluid end 100, for example via the aperture 306, and is rotatable about a pawl axis 1206. The pawl 1202 includes an inner profile 1208 and an outer profile 1210. In this embodiment, the inner profile 1208 and outer profile 1210 are different, in that the inner profile 1208 has a more pronounced concave bend. It should be appreciated that inner and outer are used for illustrative and clarification purposes, and that such labels are not intended to limit embodiments of the present disclosure. For example, inner was selected in this instance because the inner profile 1208 is the leading edge of rotation about the pawl axis 1206 when moving the pawl 1202 into engagement with the ratchet 1204.

The illustrated pawl 1202 includes a contact region 1212, which is positioned to engage the valleys 312 of the wear sleeve retainer 204 (e.g., of the ratchet 1204). In operation, the pawl 1202 is rotated about the pawl axis 1206, in either a clockwise or counter-clockwise direction, to bring the contact region 1212 into the valleys 312. The pawl 1202 may be secured, such as via a fastener or spring to block rotation in an opposite direction, and as a result, block rotation of the wear sleeve retainer 204.

Figure 12B:
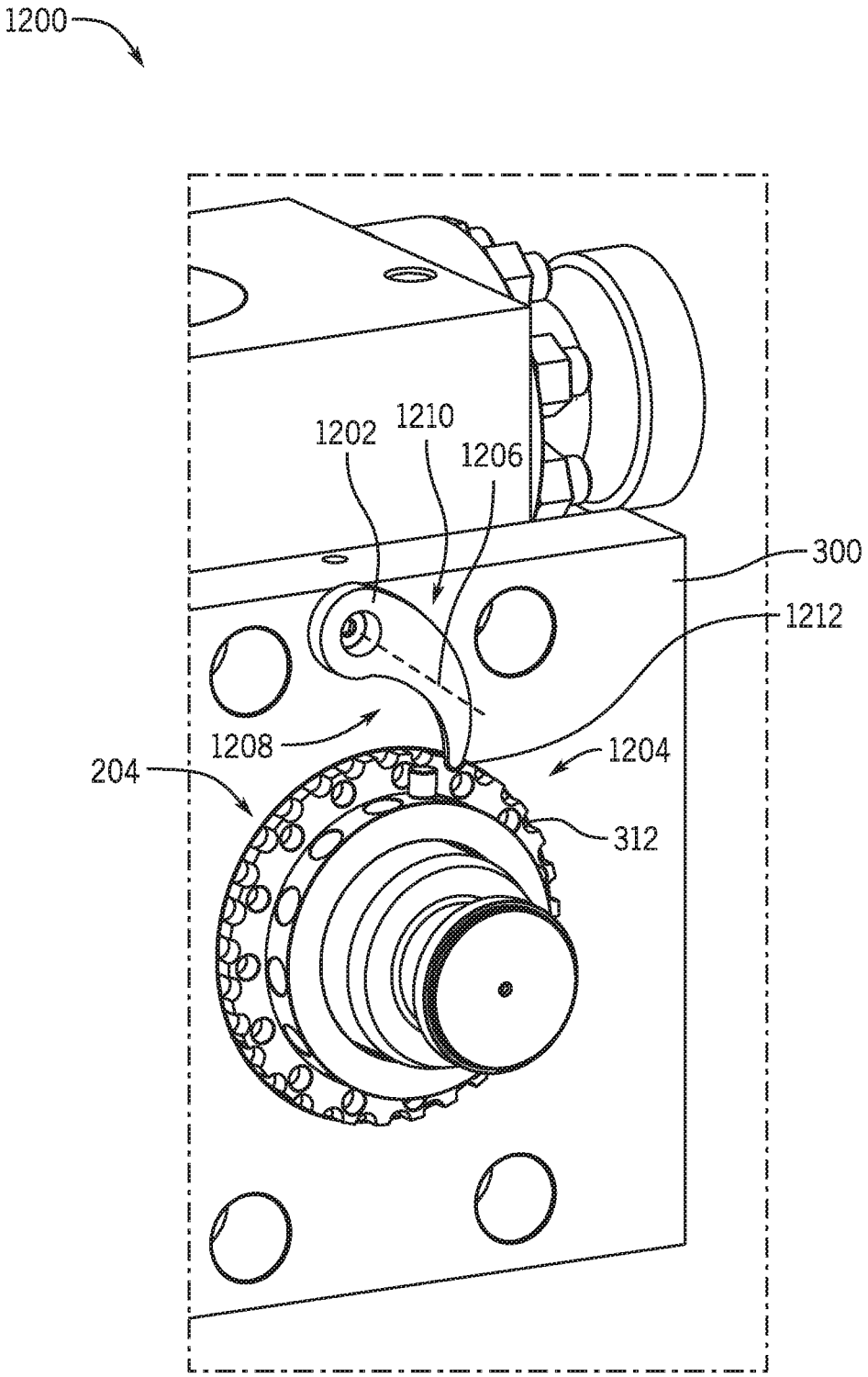

FIG. 12B is a perspective view of the ratchet and pawl system 1200 where the pawl 1202 has been rotated about the pawl axis 1206 to engage the ratchet 1204. Specifically, the contact region 1212 is positioned within the valley 312 after the pawl 1202 is rotated in the clockwise direction (compared to the position shown in FIG. 12A). As noted above, further rotation of the pawl 1202 may be blocked, for example via a fastener, spring or the like, and as a result, the pawl 1202 blocks rotation of the wear sleeve retainer 204 in the counter-clockwise direction. In this manner, the wear sleeve retainer 204 may be secured to the fluid end 100 without externally bolting through the wear sleeve retainer, as is done with current systems. This simplifies installation and reduces the number of bolts utilized at the site. It should be appreciated that, in other embodiments, rotation directions may be changed and still be within the scope of the present disclosure.

Figure 13:
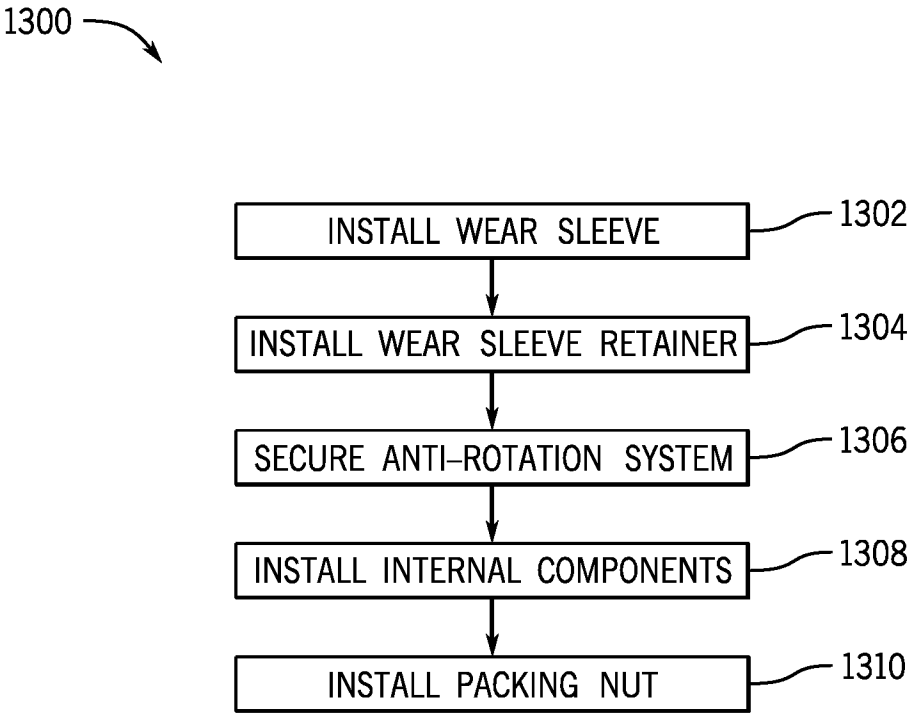
FIG. 13 is a flow chart of an embodiment of a method for a retainer system, in accordance with embodiments of the present disclosure.

FIG. 13 is a flow chart of an embodiment of a method 1300 for installing a retainer system. It should be appreciated that this method, and all methods described herein, may include more or fewer steps. Additionally, the steps may be performed in a different order, or in parallel, unless otherwise specifically stated. The illustrated example includes installing the wear sleeve 1302. For example, the wear sleeve may be arranged within a bore. In various embodiments, one or more landing or locating features may be included to facilitate arrangement of the wear sleeve. The wear sleeve retainer is installed 1304. The wear sleeve retainer may be threaded to internal threads formed in a housing to eliminate external fasteners, which may be time consuming and difficult to install. An anti-rotation system may be utilized to block rotation of the wear sleeve retainer 1306. For example, a fastener may apply an opposing force to the wear sleeve retainer to prevent rotation in a direction that would cause the wear sleeve retainer to back off. In various embodiments, internal components are installed 1308, such as packing and the like. Then, a packing nut may be installed 1310, among other components, to enable operation of the pumping system.

The foregoing disclosure and description of the disclosed embodiments is illustrative and explanatory of the embodiments of the disclosure. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. A wear sleeve retainer system, comprising:

a wear sleeve retainer, comprising:

a body portion extending for a length, the body portion having a bore extending along an axis;

a mating component extending from the body portion and into the bore, the mating component being annular and having a smaller diameter than a bore diameter;

threads arranged circumferentially about at least a portion of an outer diameter of the body portion;

second threads extending along at least a portion of the bore, the second threads ending prior to the mating component; and a profile formed about at least a portion of a face of the body portion, the profile including a valley and a flat, the valley having a smaller valley diameter than a flat diameter; and an anti-rotation system, comprising:

a locking mechanism; and a locking fastener extending through the locking mechanism at an angle, the locking fastener adapted to engage the valley.

2. The system of claim 1, wherein the wear sleeve retainer further comprises:

a plurality of blinds formed along the face of the body portion, the blinds being positioned circumferentially about the face and radially outward from the bore.

3. The system of claim 2, wherein a blind of the plurality of blinds is adapted to be engaged by a lock body having an extension, the lock body being used to install the wear sleeve retainer and to drive rotation of the wear sleeve retainer about an axis.

4. The system of claim 2, wherein each blind of the plurality of blinds is arranged radially inward from the valley and the flat.

5. The system of claim 1, wherein the locking fastener is a threaded fastener.

6. The system of claim 1, wherein the profile further comprises:

a plurality of valleys positioned circumferentially about the face; and a plurality of flats positioned circumferentially about the face, wherein adjacent valleys are separated by adjacent flats.

7. A fluid end, comprising:

a housing having a bore extending toward a cavity;

a wear sleeve positioned within the bore;

a plunger positioned within a plunger bore extending through the wear sleeve, the plunger reciprocating within the plunger bore;

a wear sleeve retainer coupled to the housing and positioned to block axial movement of the wear sleeve, the wear sleeve retainer having external threads along a body that engage internal threads formed in the housing;

an anti-rotation system, coupled to the housing, the anti-rotation system engaging the wear sleeve retainer to block rotation of the wear sleeve retainer in at least one direction; and a packing nut coupled to the wear sleeve retainer.

8. The fluid end of claim 7, wherein the wear sleeve retainer further comprises:

a profile extending around a circumference of a face, the profile including a plurality of valleys and a plurality of flats, each valley having a smaller diameter than each flat, wherein each valley is adapted to receive a locking fastener from the anti-rotation system.

9. The fluid end of claim 7, wherein the wear sleeve retainer is aligned with the plunger bore and includes internal threads, the internal threads mating with external threads of the packing nut to couple the packing nut to the wear sleeve retainer.

10. The fluid end of claim 7, wherein the anti-rotation system comprises:

a locking mechanism coupled to the housing; and a locking fastener extending through the locking mechanism, the locking fastener arranged to engage the wear sleeve retainer at an angle to block a rotational force applied to the wear sleeve retainer.

11. The fluid end of claim 7, wherein the anti-rotation system comprises:

a pawl coupled to the housing, the pawl being rotatable about a pawl axis, wherein the pawl engages a profile extending around a circumference of the wear sleeve retainer.

12. The fluid end of claim 7, wherein the wear sleeve retainer further comprises:

at least a portion of the plunger bore; and a mating component extending into the plunger bore, the mating component having a smaller diameter than the plunger bore, the mating component contacting the wear sleeve, when the wear sleeve retainer is installed within the housing, to block axial movement of the wear sleeve.

13. The fluid end of claim 7, wherein the wear sleeve retainer further comprises:

a plurality of blinds arranged circumferentially about the face, the plurality of blinds being positioned radially inward of the profile.

14. The fluid end of claim 13, wherein at least one blind of the plurality of blinds is adapted to be engaged by a lock body having an extension, the lock body adapted to couple to a rotational tool to drive rotation of the wear sleeve retainer about an axis.

15. A method for installing a retainer system, comprising:

positioning packing seal elements within a diameter of a wear sleeve while the wear sleeve is external to a fluid end housing;

positioning the wear sleeve within a bore formed in the fluid end housing;

securing a wear sleeve retainer to the fluid end housing by threading the wear sleeve retainer into the fluid end housing, wherein external threads on a body of the wear sleeve retainer engage internal threads in the bore, the wear sleeve retainer engaging at least a portion of the wear sleeve;

securing an anti-rotation system to the wear sleeve retainer; and threading a packing nut to the wear sleeve retainer.

16. The method of claim 15, wherein securing the anti-rotation system further comprises:

engaging an outer profile of the wear sleeve retainer via a locking fastener, the outer profile including a series of valleys and flats having different respective diameters.

17. The method of claim 15, further comprising:

engaging blinds formed on the wear sleeve retainer, via a lock body; and rotating the wear sleeve retainer.

18. A wear sleeve retainer system, comprising:

a body portion extending for a length, the body portion having a bore extending along an axis;

a mating component extending from the body portion and into the bore, the mating component being annular and having a smaller diameter than a bore diameter;

threads arranged circumferentially about at least a portion of an outer diameter of the body portion;

second threads extending along at least a portion of the bore, the second threads ending prior to the mating component;

a profile formed about at least a portion of a face of the body portion, the profile including a valley and a flat, the valley having a smaller valley diameter than a flat diameter; and a plurality of blinds formed along the face of the body portion, the blinds being positioned circumferentially about the face and radially outward from the bore.

19. The wear sleeve retainer system of claim 18, further comprising:

an anti-rotation system, comprising:

a locking mechanism; and a locking fastener extending through the locking mechanism at an angle, the locking fastener adapted to engage the valley.

20. The system of claim 19, wherein the locking fastener is a threaded fastener.

21. The system of claim 18, wherein a blind of the plurality of blinds is adapted to be engaged by a lock body having an extension, the lock body being used to install the wear sleeve retainer and to drive rotation of the wear sleeve retainer about an axis.

22. The system of claim 18, wherein each blind of the plurality of blinds is arranged radially inward from the valley and the flat.

23. The system of claim 18, wherein the profile further comprises:

a plurality of valleys positioned circumferentially about the face; and a plurality of flats positioned circumferentially about the face, wherein adjacent valleys are separated by adjacent flats.

* * * * *